US012805670B1

(12) United States Patent
Giraldo et al.

(10) Patent No.: US 12,805,670 B1
(45) Date of Patent: Nov. 24, 2026

(54) PRODUCT DISPENSER

(71) Applicant: BEE WILD OUTSIDE, INC., Albuquerque, NM (US)

(72) Inventors: Camilo Giraldo, Los Angeles, CA (US); Kathy Silva, Los Angeles, CA (US); Alexandra Merlino, Santa Fe, NM (US); Curtis Young, Los Angeles, CA (US)

(73) Assignee: Bee Wild Outside, Inc., Albuquerque, NM (US)

( * ) Notice: Subject to any disclaimer, the term of this patent is extended or adjusted under 35 U.S.C. 154(b) by 67 days.

(21) Appl. No.: 18/765,326

(22) Filed: Jul. 7, 2024

Related U.S. Application Data

(60) Provisional application No. 63/512,602, filed on Jul. 7, 2023.

(51) Int. Cl.
*A47K 5/12* (2006.01)

(52) U.S. Cl.
CPC ..... *A47K 5/1201* (2013.01)

(58) Field of Classification Search
CPC .. A47K 5/1205; A47K 5/1201; A47K 5/1211; B05B 11/0038
USPC ..... 222/153.01, 182–184, 192, 321.7, 321.9, 222/325, 401
See application file for complete search history.

(56) References Cited

U.S. PATENT DOCUMENTS

D228,121 S 8/1973 Sway
4,320,856 A * 3/1982 Stewart ..... B67D 1/0425 222/401
D465,149 S 11/2002 Bennett et al.
6,983,864 B1 * 1/2006 Cagle ..... B05B 11/0038 222/321.9
D668,552 S 10/2012 Wisniewski
D788,586 S 6/2017 Molinari
9,913,561 B1 * 3/2018 Rodriguez ..... A47K 5/1201
D842,111 S 3/2019 Delia
D858,890 S 9/2019 Teller et al.
D858,891 S 9/2019 Teller et al.
D870,388 S 12/2019 Cleij
D903,498 S 12/2020 Marcio et al.
D926,582 S 8/2021 Sahatjian
11,084,646 B1 * 8/2021 Hwang ..... B05B 11/0054
D941,151 S 1/2022 Bracher
D946,814 S 3/2022 Liu
D951,772 S 5/2022 Sahatjian
D1,022,699 S 4/2024 Frias et al.
D1,022,700 S 4/2024 Frias et al.
2007/0108092 A1 5/2007 Minuto et al.
(Continued)

OTHER PUBLICATIONS

Mild East 3pcs 20ml Sterile Airless Pump Bottle with Funnel Easy to Carry and Fill Matte Lotion Bottles for Travel; Amazon.com (https://www.amazon.com/gp/product/B074GPSSQ2/ref=ppx_yo_dt_b_search_asin_title?ie=UTF8&psc=1), 11 pgs., May 31, 2023.

(Continued)

*Primary Examiner* — Luan K Bui
(74) *Attorney, Agent, or Firm* — Mackey Law Firm PLLC

(57) ABSTRACT

A dispenser can include a case having a chamber therein and a dispenser outlet in communication with the chamber, a container disposed within the chamber, a pump assembly including a pump having a pump outlet removably coupled to the dispenser outlet, and a trigger configured to activate the pump.

25 Claims, 22 Drawing Sheets

(56) References Cited

U.S. PATENT DOCUMENTS

| | | | | |
|---|---|---|---|---|
| 2012/0234863 | A1* | 9/2012 | Kahler | B05B 11/1053 222/321.9 |
| 2013/0146618 | A1* | 6/2013 | Bae | B65D 83/7711 222/212 |
| 2022/0047124 | A1* | 2/2022 | Rutchik | A47K 5/1201 |

OTHER PUBLICATIONS

Korres Black Pine 3D Eye-Lift Super Serum; Amazon.com (https://www.amazon.com/KORRES-Black-Eye-Lift-Super-Circles/dp/B09B5FPDFS/ref=asc_df_B09B5FPDFS?tag=bngsmtphsnus-20&linkCode=df0&hvadid=80401918269793&hvnetw=s&hvqmt=e&hvbmt=be&hvdev=c&hvlocint=&hvlocphy=&hvtargid=pla-458400144009490 3&psc=1), 10 pgs., Nov. 24, 2024.

* cited by examiner

PRODUCT DISPENSER

CROSS-REFERENCE TO RELATED APPLICATIONS

This application claims the benefit of U.S. Provisional Patent Application No. 63/512,602 filed Jul. 7, 2023, the entire contents of which are incorporated herein by reference.

TECHNICAL FIELD

The present disclosure relates generally to product dispensers and more specifically relates to dispensers for products such as lotions.

BACKGROUND

Most currently existing dispensers for products such as lotions are one-time use only and/or are not recyclable, which creates significant waste. This is even more troubling in that most currently existing dispensers for products such as lotions are made of plastic, thus creating significant plastic waste.

SUMMARY

Applicant has created new and useful devices, systems and methods for dispensing products such as lotions. In at least one embodiment, a dispenser can include a case having a chamber therein and a dispenser outlet in communication with the chamber, a container disposed within the chamber, a pump assembly including a pump having a pump outlet that can be removably coupled to the dispenser outlet, a trigger that can be configured to activate the pump, or any combination thereof. In at least one embodiment, the case can include a first case portion removably coupled to a second case portion. In at least one embodiment, the dispenser outlet can be through the first case portion. In at least one embodiment, the trigger can be coupled to the second case portion. In at least one embodiment, the pump assembly can include a collar removably coupled to the container.

In at least one embodiment, the container can be metal. In at least one embodiment, the container can be removably and/or replaceably coupled to the case. In at least one embodiment, the dispenser can include a lanyard hole disposed through a portion of the case.

In at least one embodiment, the trigger can be configured to selectively move the container and the collar towards the dispenser outlet. In at least one embodiment, the trigger can be slideably coupled to the second case portion. In at least one embodiment, at least a portion of the trigger can be accessible through an opening in a wall of the second case portion. In at least one embodiment, the trigger can include an air hole in fluid communication with an atmosphere surrounding the dispenser.

In at least one embodiment, the trigger comprises features that interplay with the second case portion to guide the trigger in a linear travel path and prevent misalignment that could cause a jam. In at least one embodiment, the trigger can be rotationally fixed relative to the second case portion. In at least one embodiment, the second case portion can include a groove and the trigger can include a tongue slideably disposed within the groove.

In at least one embodiment, the dispenser can include a trigger frame disposed within the second case portion. In at least one embodiment, the trigger can be slideably coupled to the trigger frame. In at least one embodiment, the trigger frame can be configured to retain the trigger within the second case portion when the container is removed from the case.

In at least one embodiment, the first case portion can include a seat. In at least one embodiment, the pump outlet can be sealingly coupled to the seat. In at least one embodiment, the seat can include a groove in an interior wall of the first case portion, and at least a portion of the pump outlet can be disposed within the groove.

In at least one embodiment, the collar can be press fitted into the first case portion and/or the container can be press fitted into the second case portion. In at least one embodiment, the collar can retain the pump in fluid communication with an interior of the container. For example, the collar can be threadably coupled to the container thereby retaining the pump in fluid communication with an interior of the container.

In at least one embodiment, the first and second case portions can be threadably coupled to one another. In at least one embodiment, the dispenser can include a protrusion disposed in a thread on one of the first and second case portions. In at least one embodiment, the protrusion can provide a mechanical indication when the first and second case portions are fully coupled with one another. In at least one embodiment, one of the first and second case portions can drive a portion of the container into the other of the first and second case portions as the first and second case portions are threaded to one another. In at least one embodiment, one of the first and second case portions comprises a neck configured to be at least partially disposed within the other of the first and second case portions. In at least one embodiment, the container can be disposed through the neck.

In at least one embodiment, the container, the collar and the trigger can be biased in a direction away from the dispenser outlet. In at least one embodiment, the container, the collar and the trigger can be biased in a direction towards an opening through the second case portion.

In at least one embodiment, the dispenser can be water buoyant. In at least one embodiment, the dispenser can include one or more airspaces disposed radially between an external surface of the container and an external surface of the case. In at least one embodiment, at least one of the one or more air spaces can be at least partially bounded by a wall disposed radially between the external surface of the container and the external surface of the case.

In at least one embodiment, the dispenser can include a piston slideably coupled to an internal surface of the container. In at least one embodiment, the piston can be configured to move in a direction towards the dispenser outlet as a volume of a substance stored in the container decreases. In at least one embodiment, the pump can include a pump inlet end disposed within the container. In at least one embodiment, the piston can include a first end that faces towards the dispenser outlet. In at least one embodiment, the first end of the piston can include an opening configured to receive at least a portion of the pump inlet end. In at least one embodiment, the pump inlet end can include a pump inlet. In at least one embodiment, the opening in the first end of the piston can direct a substance stored in the container into the pump inlet during pump operation.

In at least one embodiment, the dispenser outlet of the first case portion can include an insert configured to ensure a tight fit with the pump outlet, thereby creating a vacuum inside the cartridge upon deactivation of the trigger. In at least one embodiment, the collar can include a self-extracting mechanism configured to be engaged by the user when unthreading the collar from the container.

In at least one embodiment, a cartridge assembly for a dispenser, such as that described above, can include a cartridge having a threaded mouth and an opposing bottom cap with an air vent therethrough, a pump configured to be threadably coupled to the threaded mouth of the cartridge, a piston pressed-fit through a bottom of the cartridge, or any combination thereof. In at least one embodiment, the piston can be secured within the cartridge by friction between one or more O-rings and an inner wall of the cartridge. In at least one embodiment, the bottom cap can provide an even surface for engaging a trigger of the dispenser and compressing the pump. In at least one embodiment, the air vent can allow air into the bottom of the cartridge, facilitating free movement of the piston within the cartridge.

In at least one embodiment, a piston assembly for a dispenser, such as that described above, can include an elongated piston to provide controlled force resistance against the vacuum and prevent misalignment, two or more circumferential grooves along the piston, two O-rings within the grooves to create a press-fit assembly within a cartridge of the dispenser, a cavity within a product facing surface of the piston configured to receive a pump of the dispenser, a beveled edge around the product facing surface of the piston body to accommodate a neck of the cartridge, or any combination thereof. In at least one embodiment, the cavity and/or the beveled edge can provide enhanced dispensing of a product from the cartridge.

DETAILED DESCRIPTION

Figure 1:
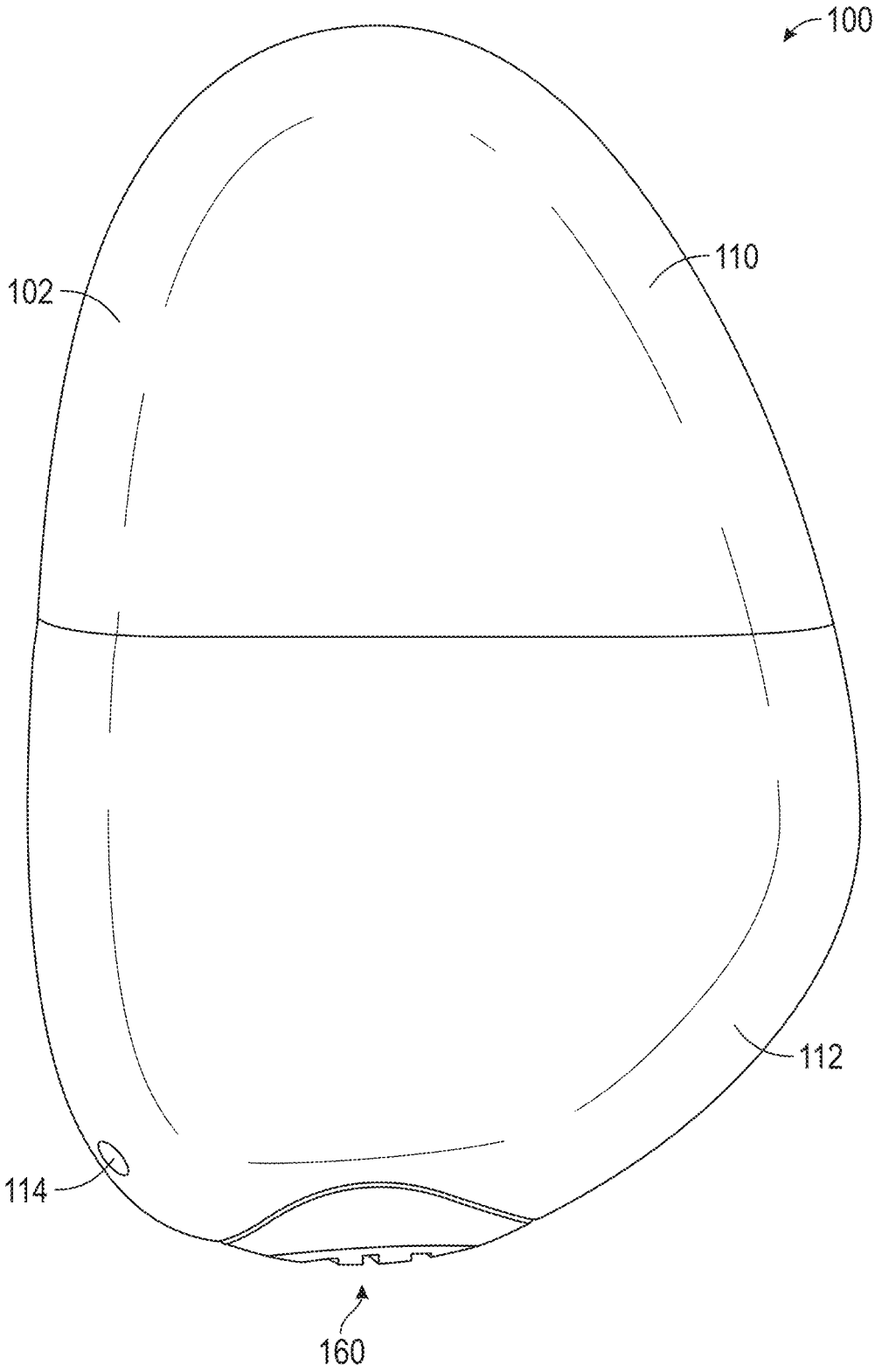
FIG. 1 is a perspective view of one of many embodiments of a dispenser according to the disclosure.

The figures described above and the written description of specific structures and functions below are not presented to limit the scope of what Applicant has invented or the scope of the appended claims. Rather, the figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms.

The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the inventions or the appended claims. The terms "including" and "such as" are illustrative and not limitative. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally. Further, all parts and components of the disclosure that are capable of being physically embodied inherently include imaginary and real characteristics regardless of whether such characteristics are expressly described herein, including but not limited to characteristics such as axes, ends, inner and outer surfaces, interior spaces, tops, bottoms, sides, boundaries, dimensions (e.g., height, length, width, thickness), mass, weight, volume and density, among others.

Applicant has created new and useful devices, systems and methods for dispensers for products such as lotions. In at least one embodiment, a dispenser can include a case having a chamber therein, a container disposed within the chamber, a pump assembly including a pump having a pump outlet that can be removably coupled to a dispenser outlet, and a trigger for selectively activating the pump. In at least one embodiment, the dispenser outlet can be disposed through a first case portion and the trigger can be slideably coupled to a second case portion. In at least one embodiment, the pump assembly can include a collar removably coupled to the container.

Figure 2:
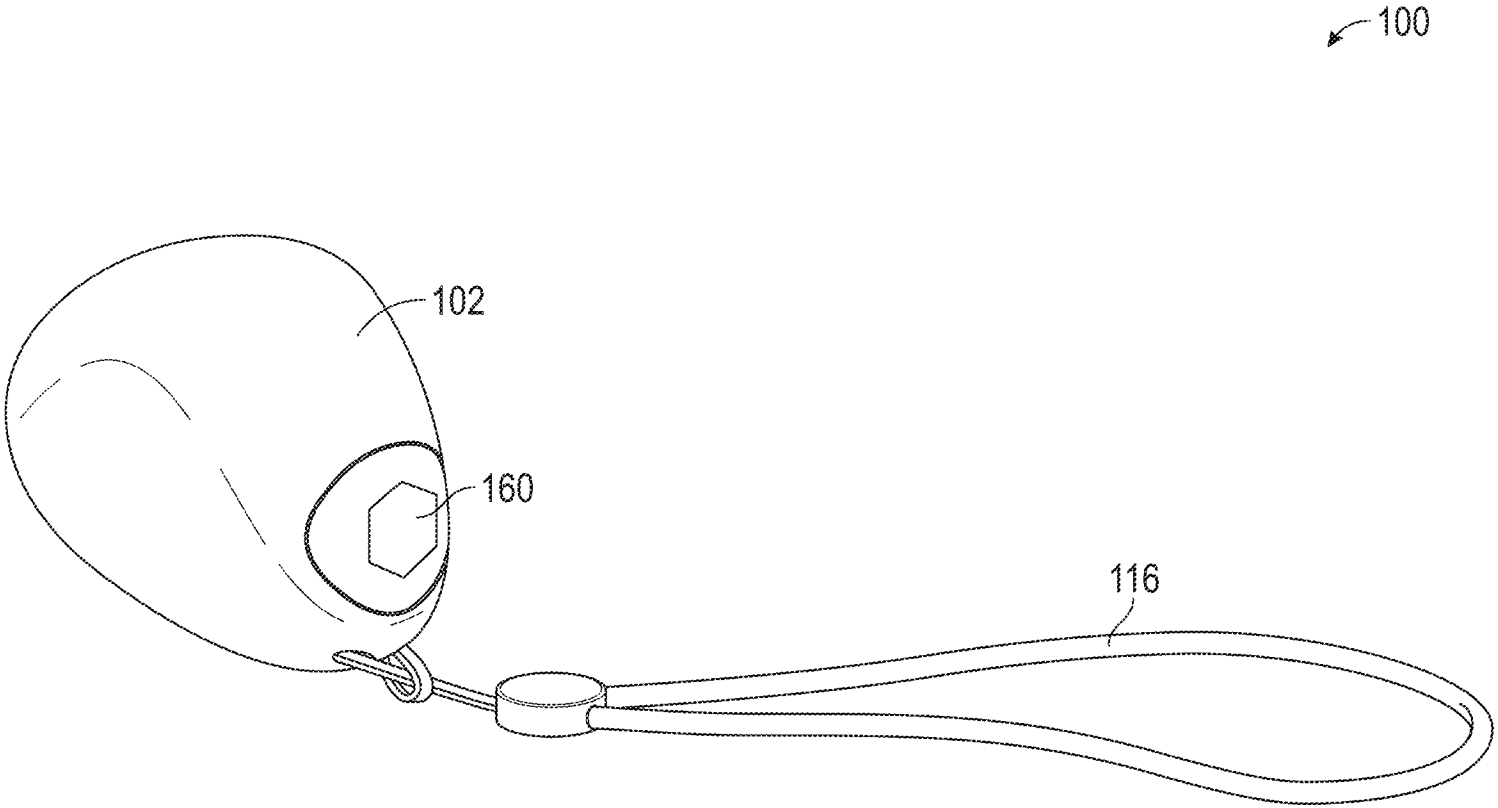
FIG. 2 is a perspective view of another one of many embodiments of a dispenser according to the disclosure.
Figure 3:
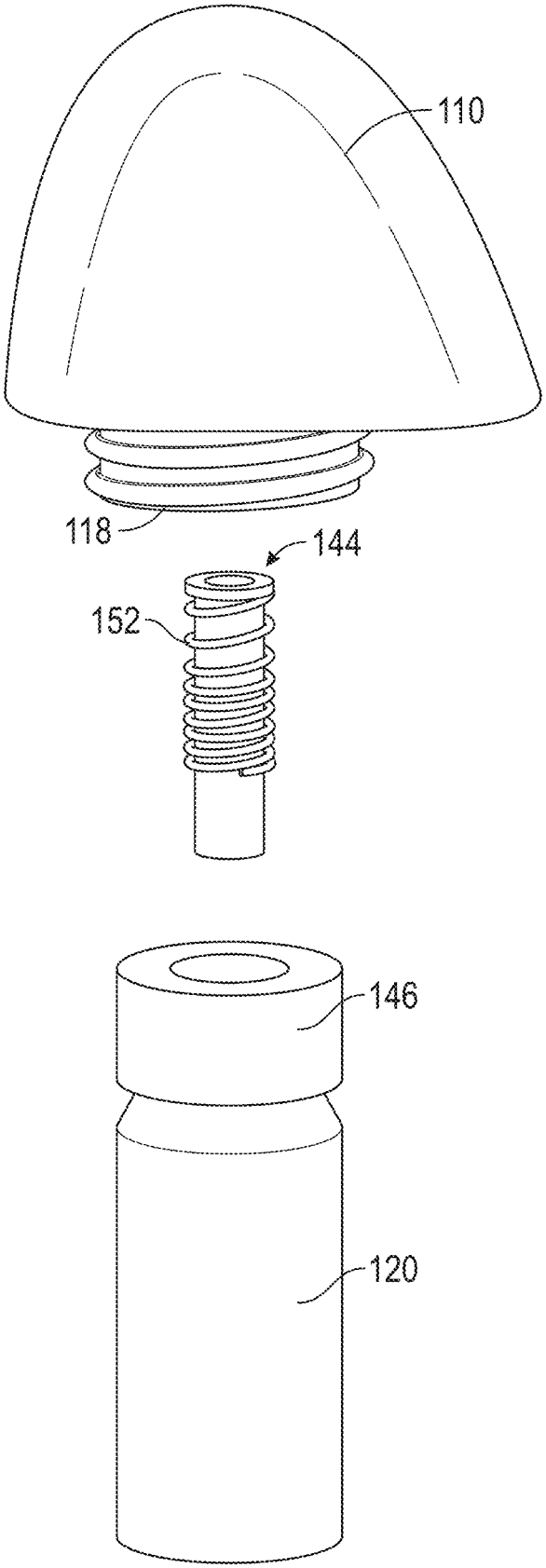
FIG. 3 is a partial exploded view showing select components of one of many embodiments of a dispenser according to the disclosure.
Figure 4:
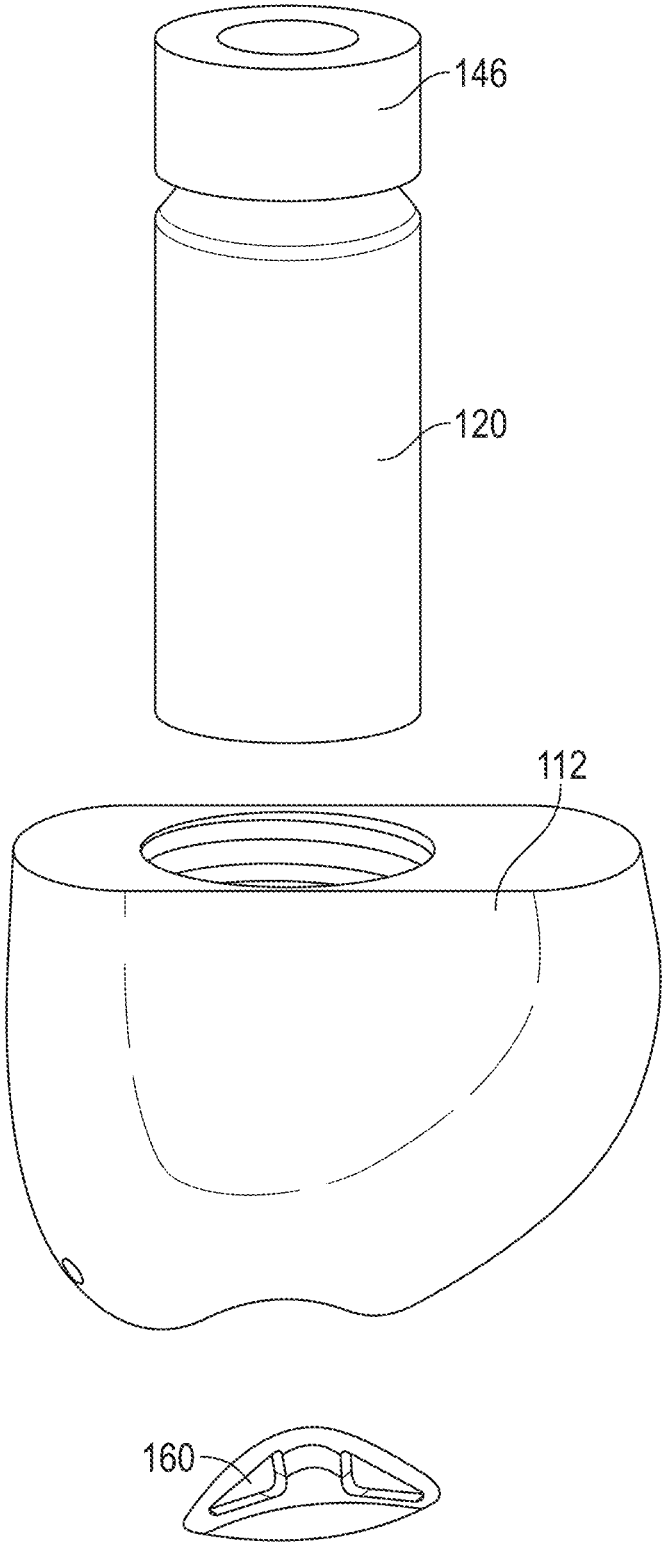
FIG. 4 is another partial exploded view showing select components of one of many embodiments of a dispenser according to the disclosure.
Figure 5:
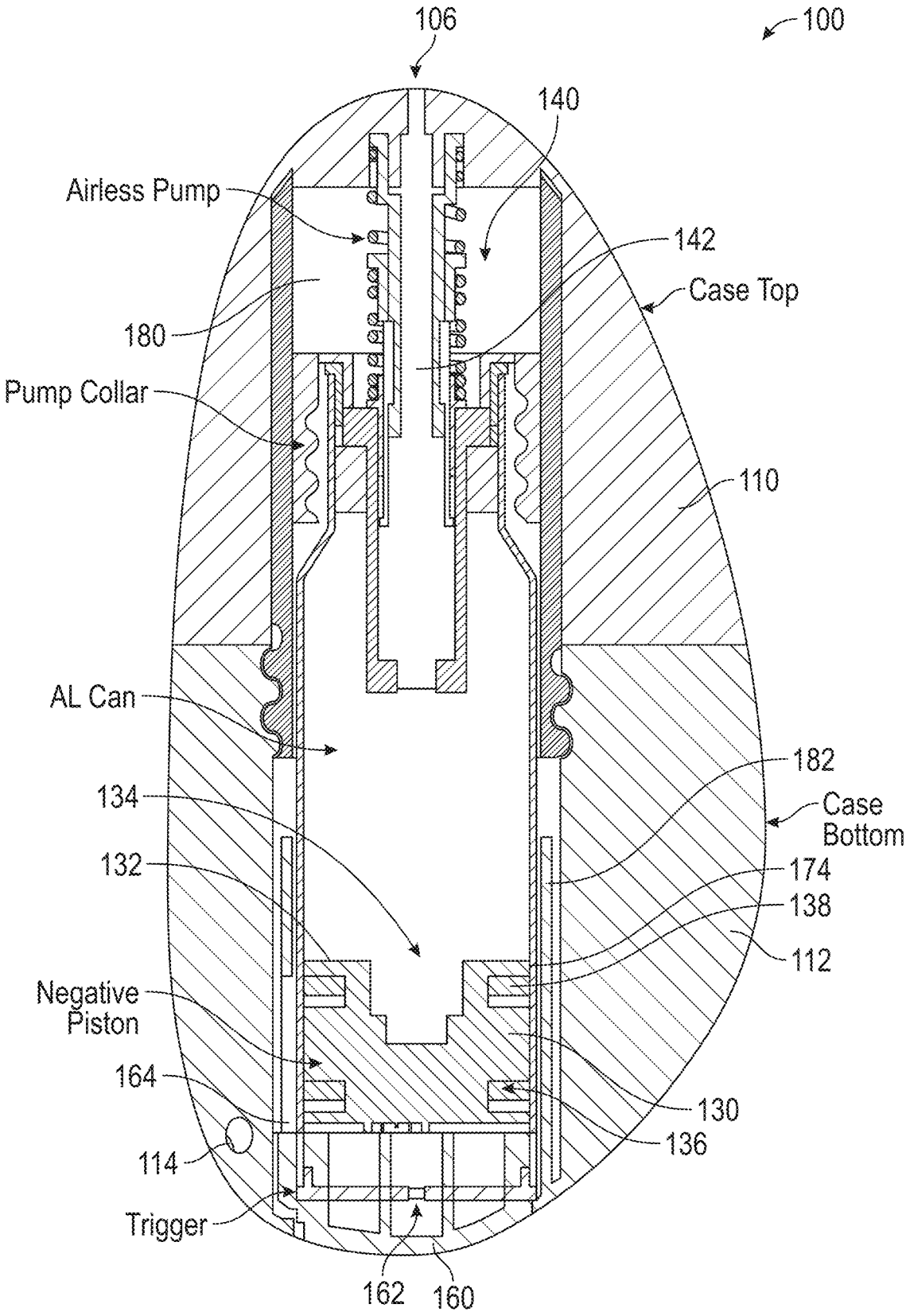
FIG. 5 is a sectional view of one of many embodiments of a dispenser according to the disclosure.
Figure 6:
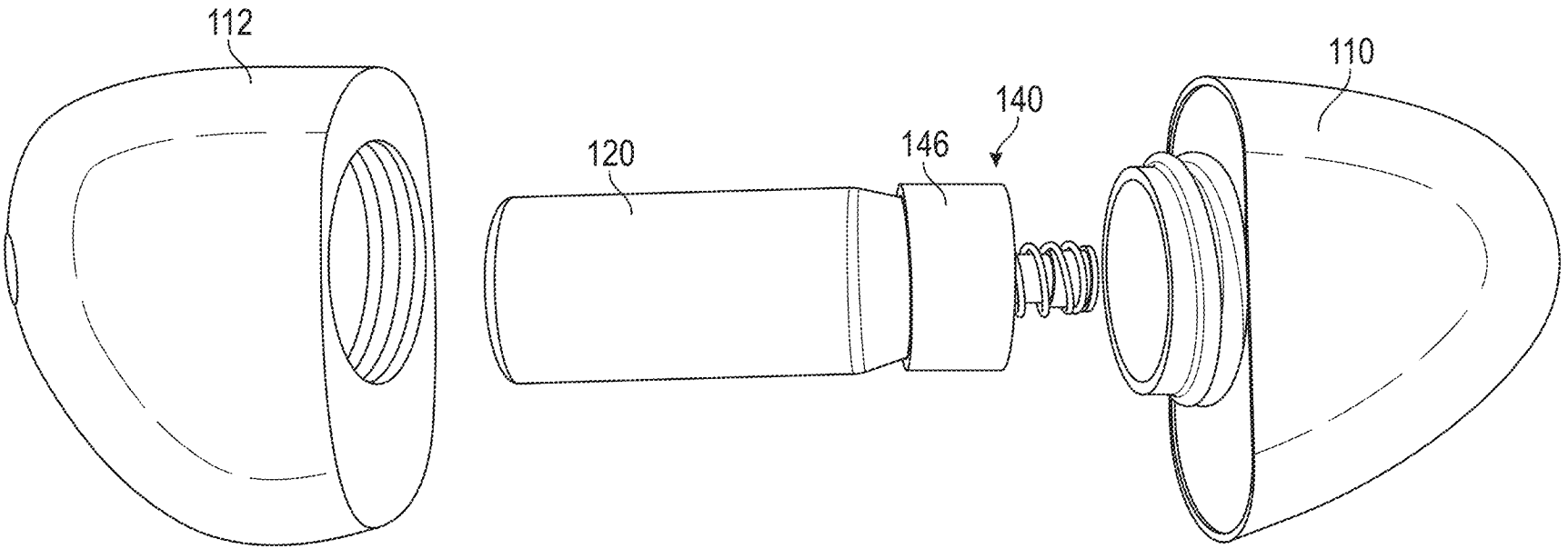
FIG. 6 is a partial exploded view of still another one of many embodiments of a dispenser according to the disclosure.
Figure 7:
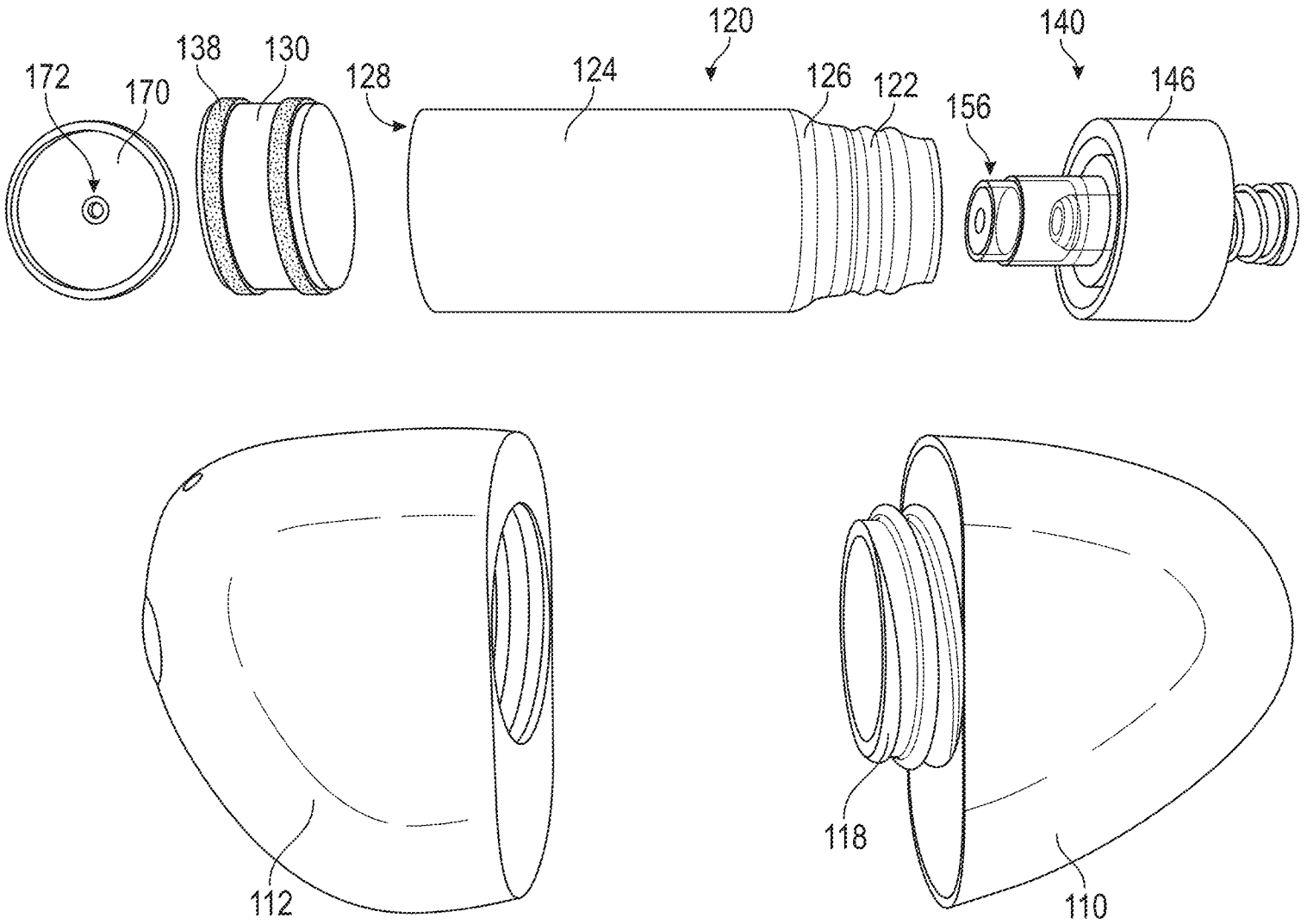
FIG. 7 is another partial exploded view of the dispenser of FIG. 6.
Figure 8:
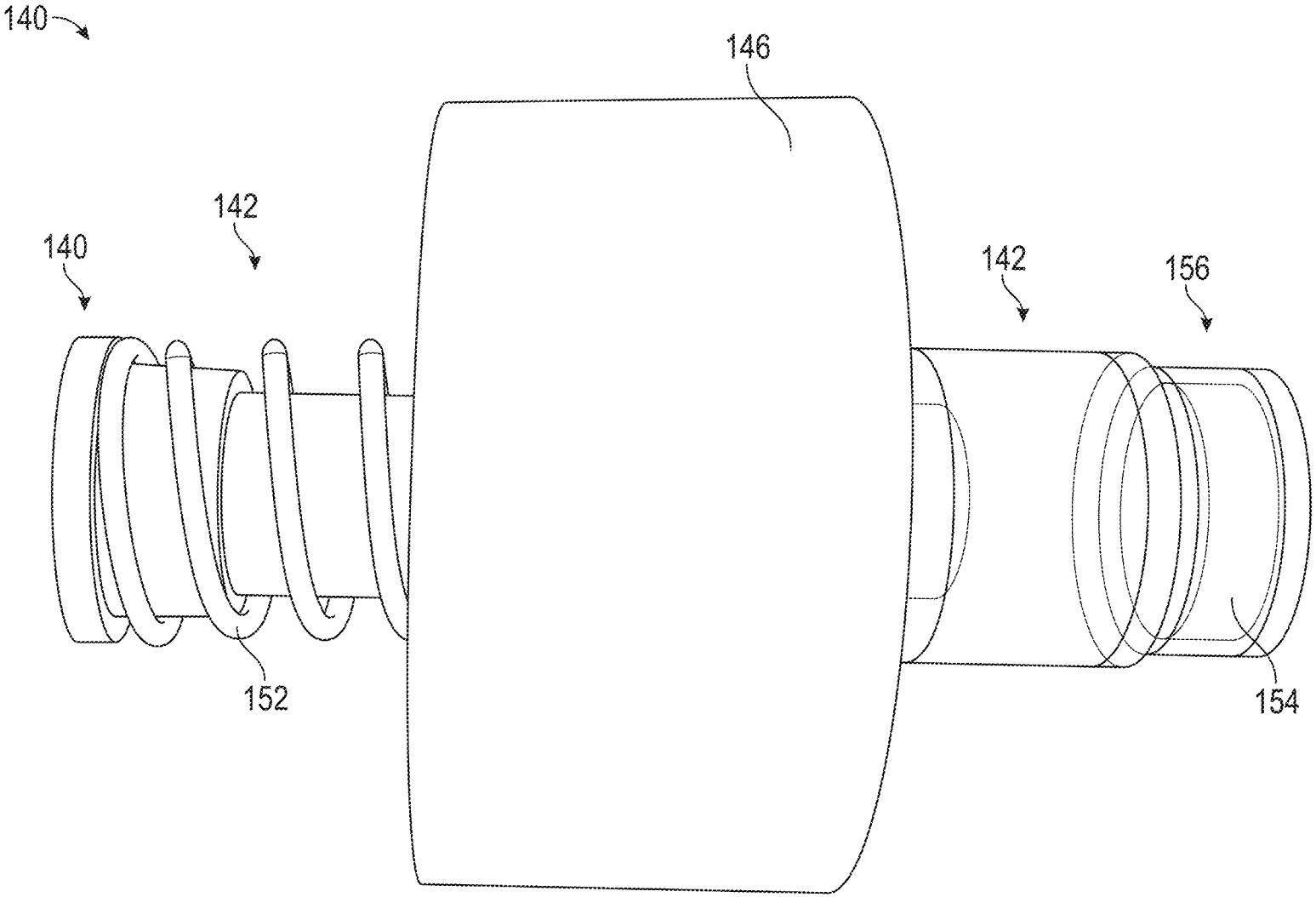
FIG. 8 is a perspective view of one of many embodiments of a pump assembly according to the disclosure.
Figure 9:
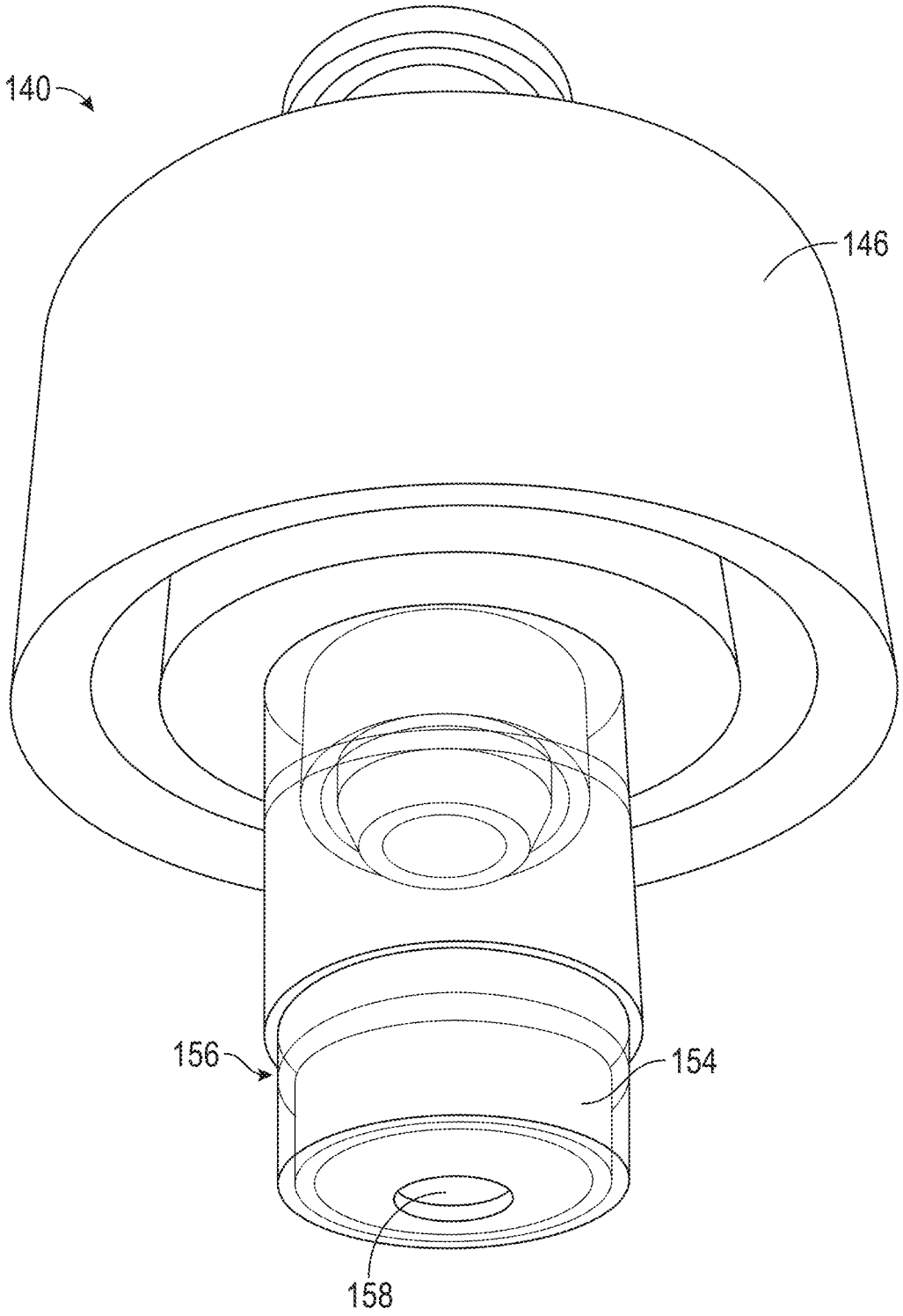
FIG. 9 is another perspective view of the pump assembly of FIG. 8.
Figure 10:
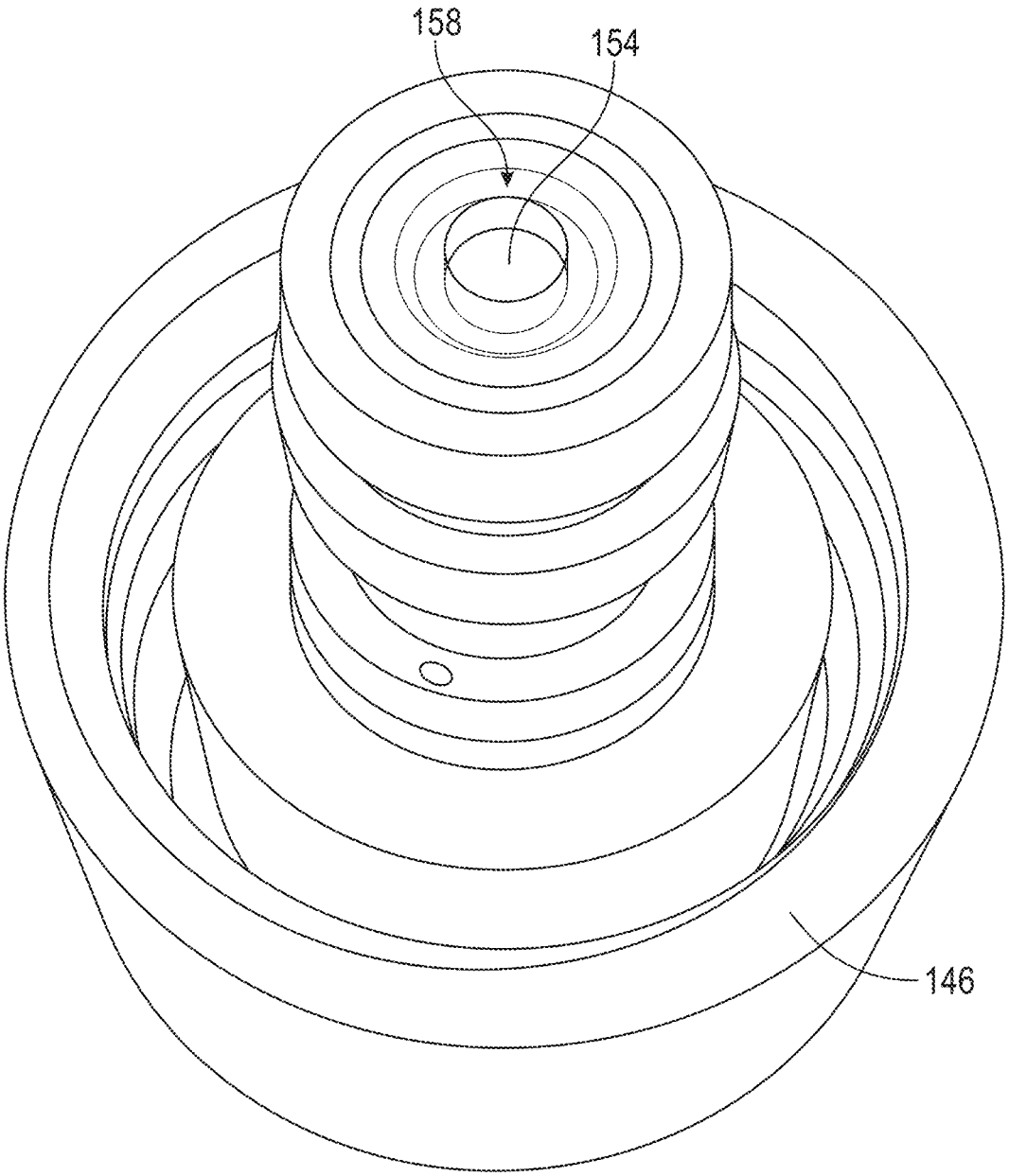
FIG. 10 is yet another perspective view of the pump assembly of FIG. 8.
Figure 11:
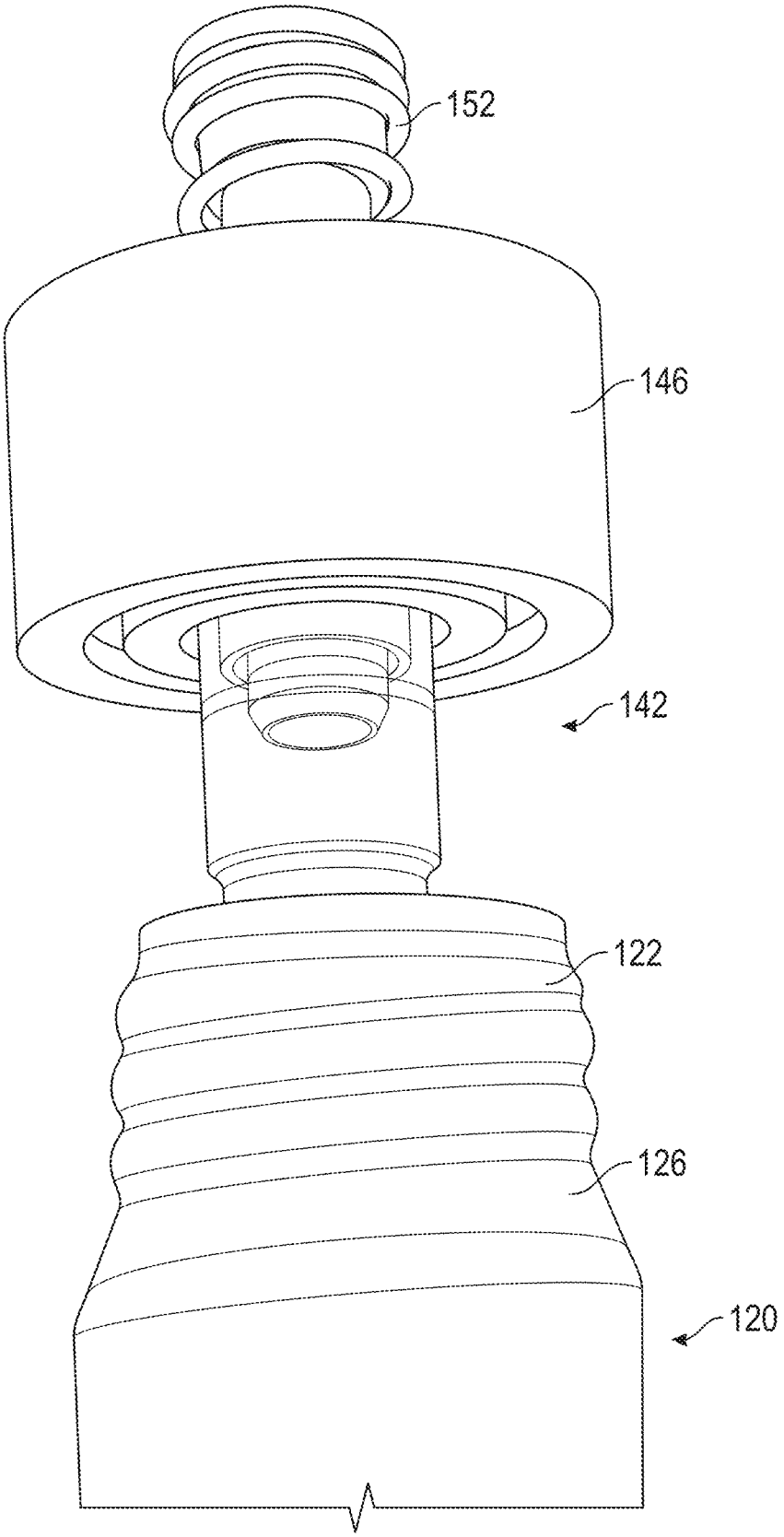
FIG. 11 is still another perspective view of the pump assembly of FIG. 8, shown with a container according to the disclosure.
Figure 12:
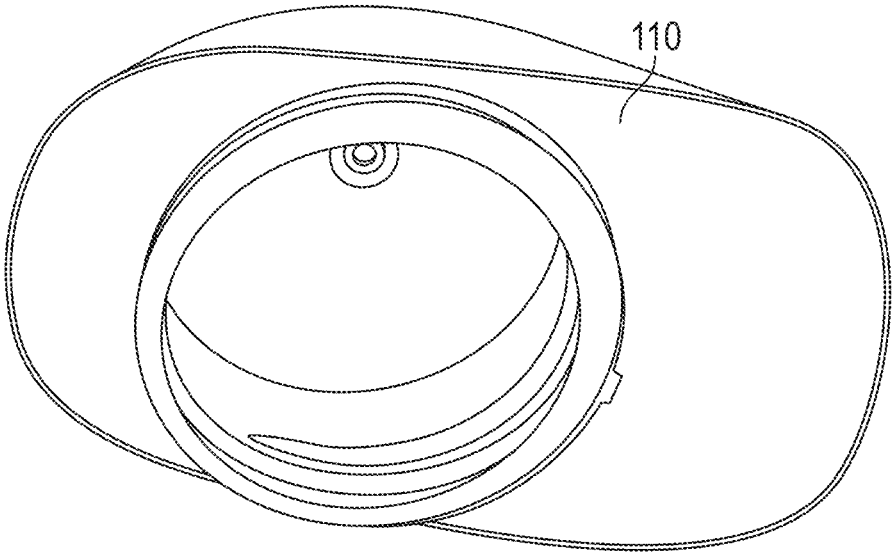
FIG. 12 is a perspective view of one of many embodiments of a first case portion according to the disclosure.
Figure 13:
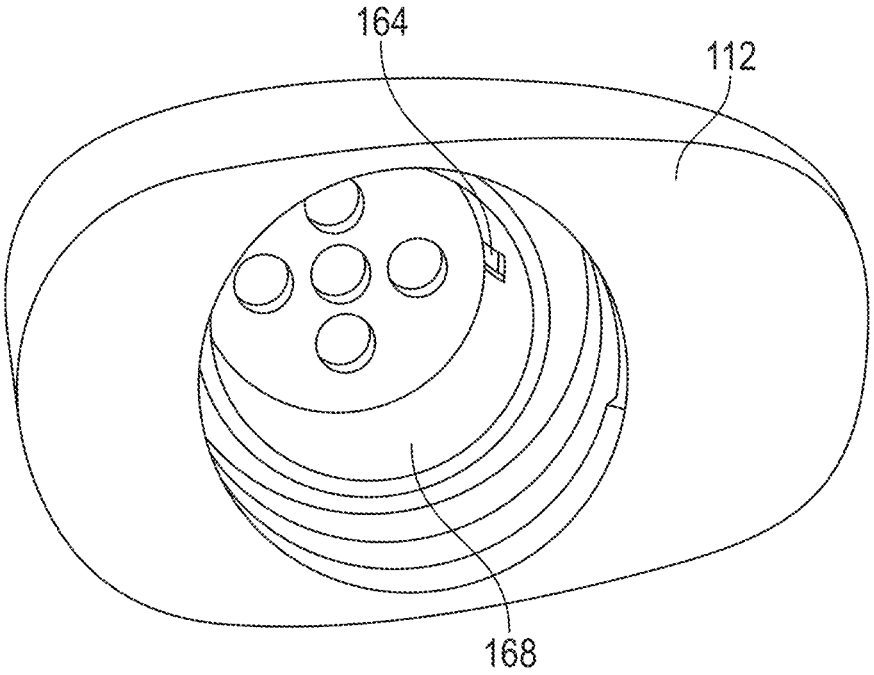
FIG. 13 is a perspective view of one of many embodiments of a second case portion according to the disclosure.
Figure 14:
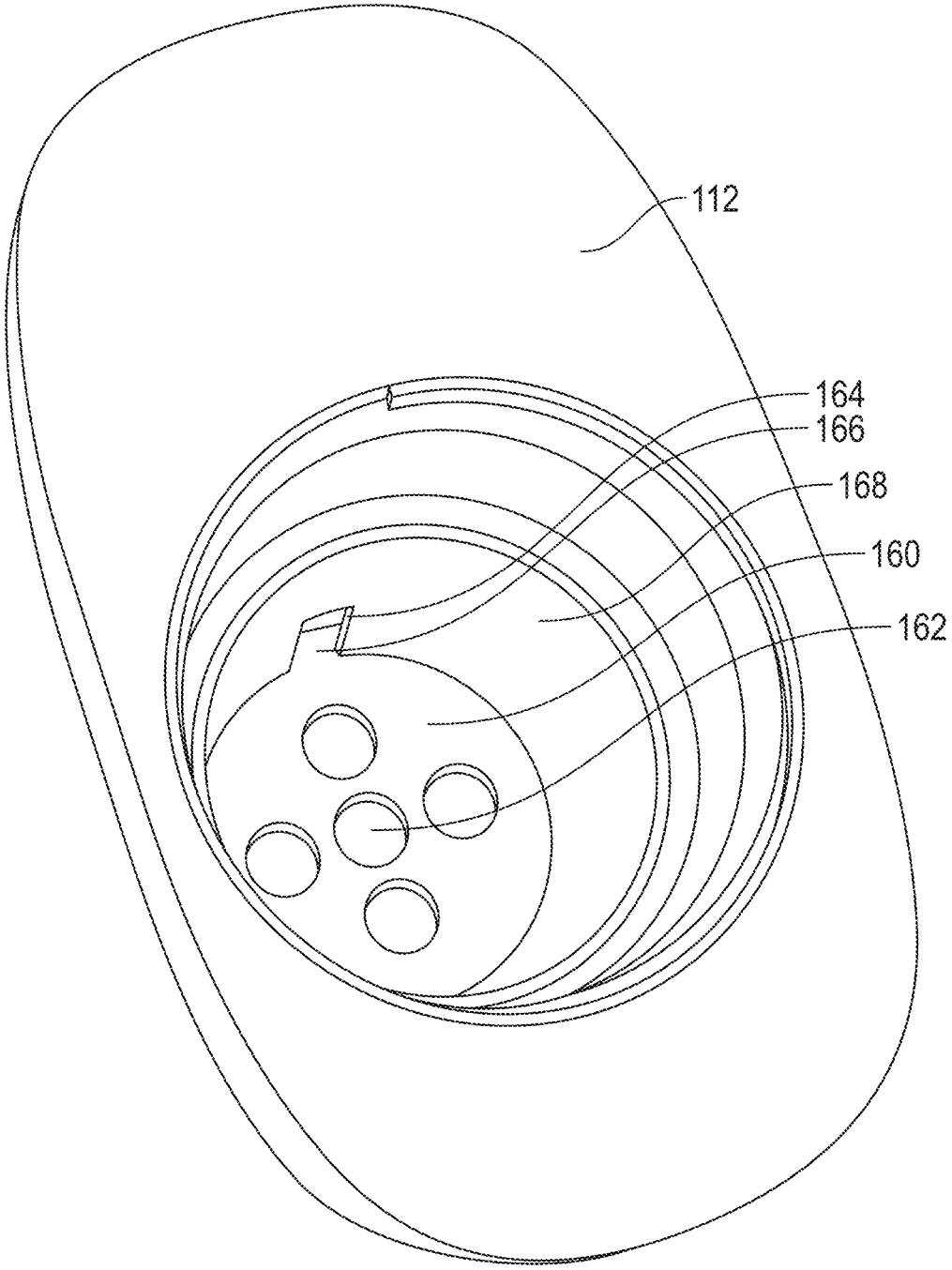
FIG. 14 is another perspective view of the second case portion of FIG. 13.
Figure 15:
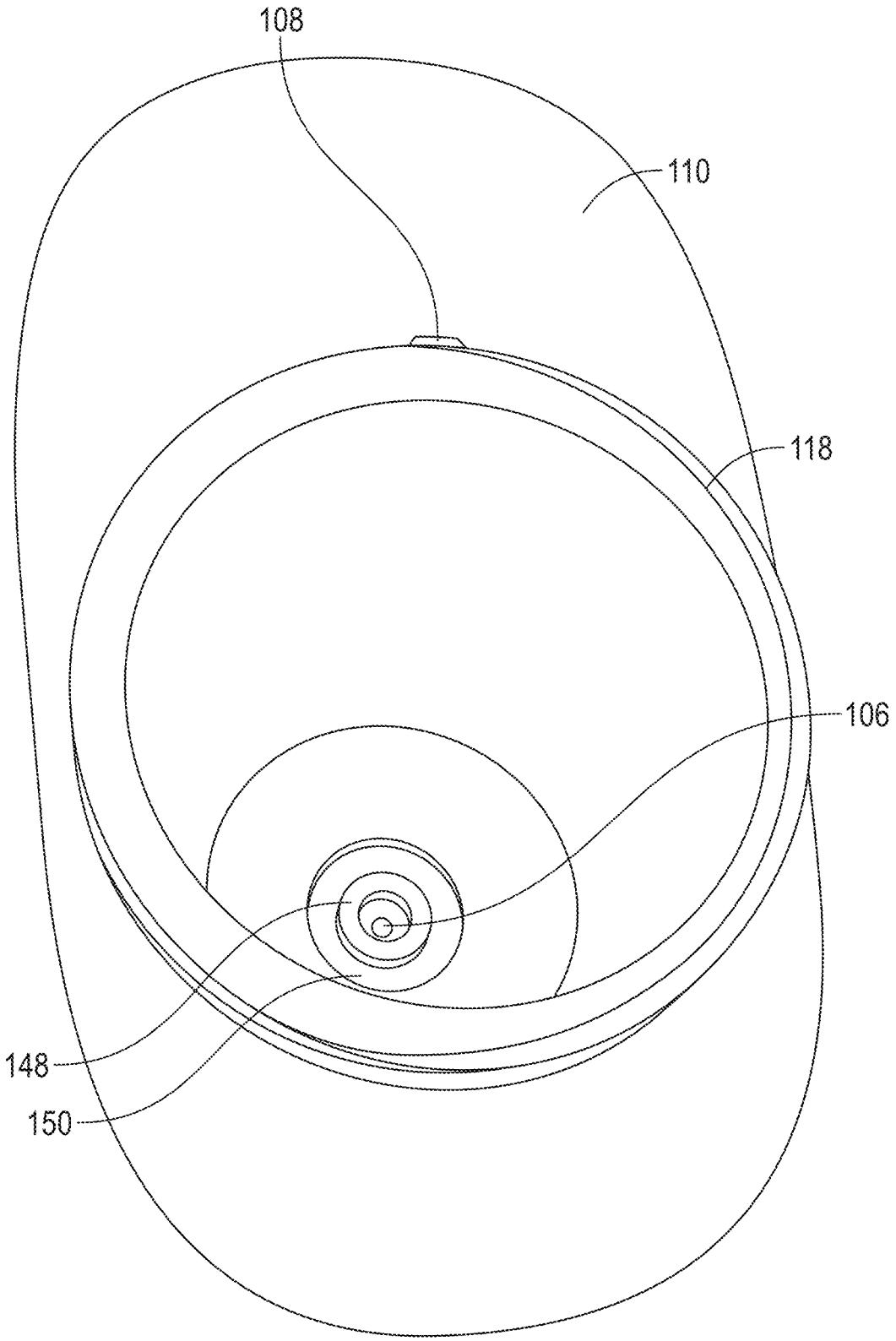
FIG. 15 is another perspective view of the first case portion of FIG. 12.
Figure 16:
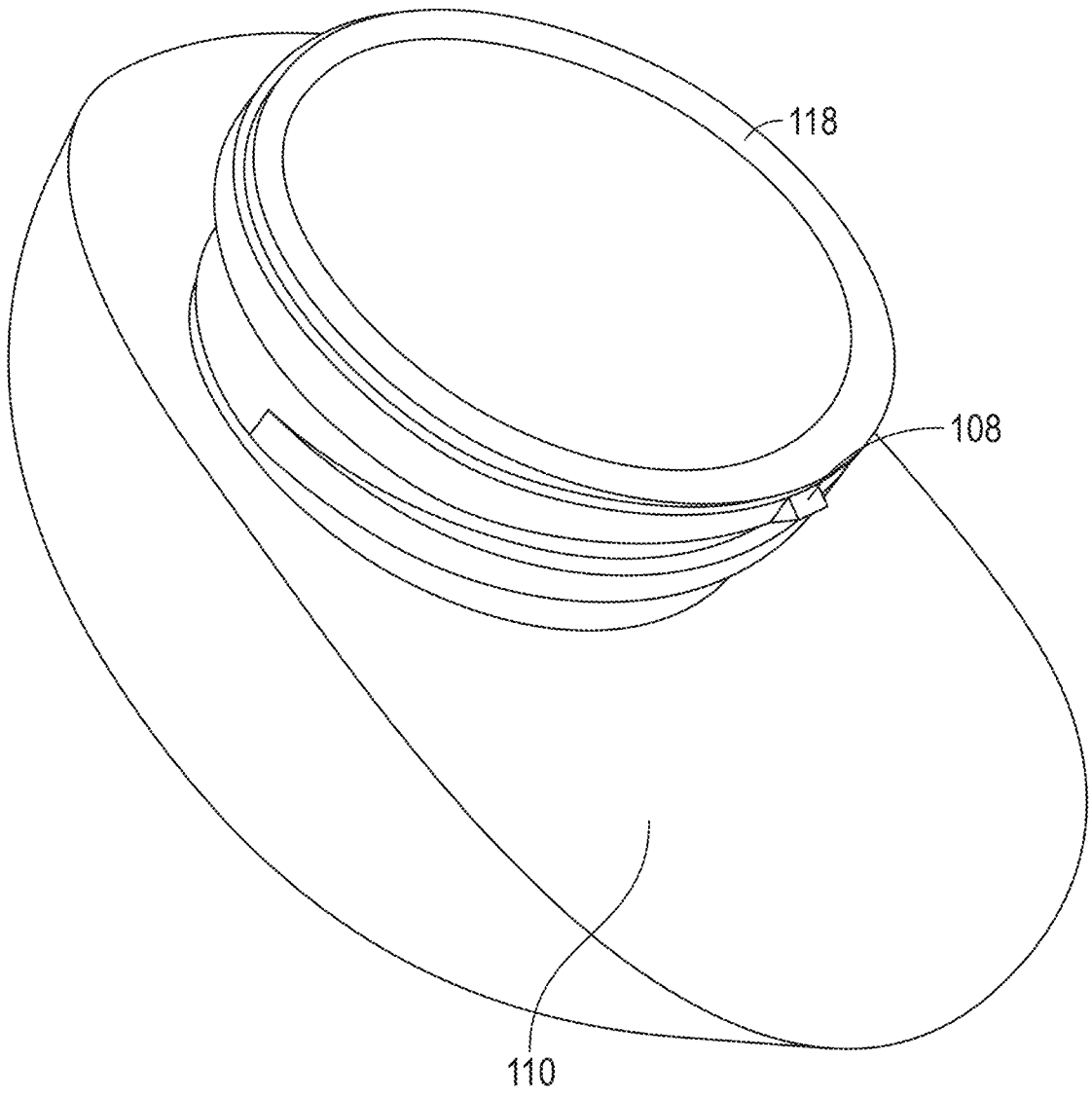
FIG. 16 is yet another perspective view of the first case portion of FIG. 12.
Figure 17:
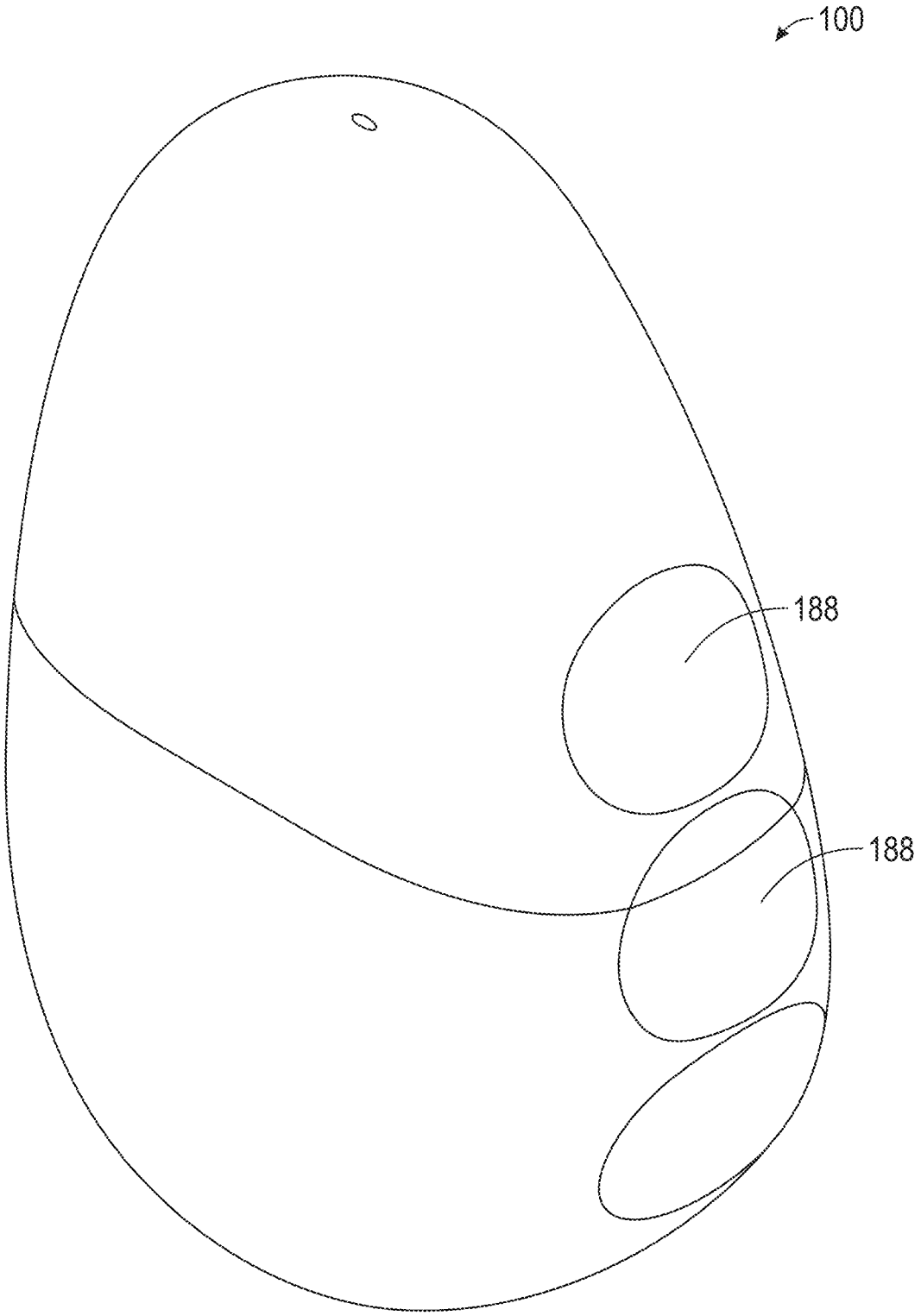
FIG. 17 is a perspective view of one of many embodiments of a dispenser having finger grooves according to the disclosure.
Figure 18:
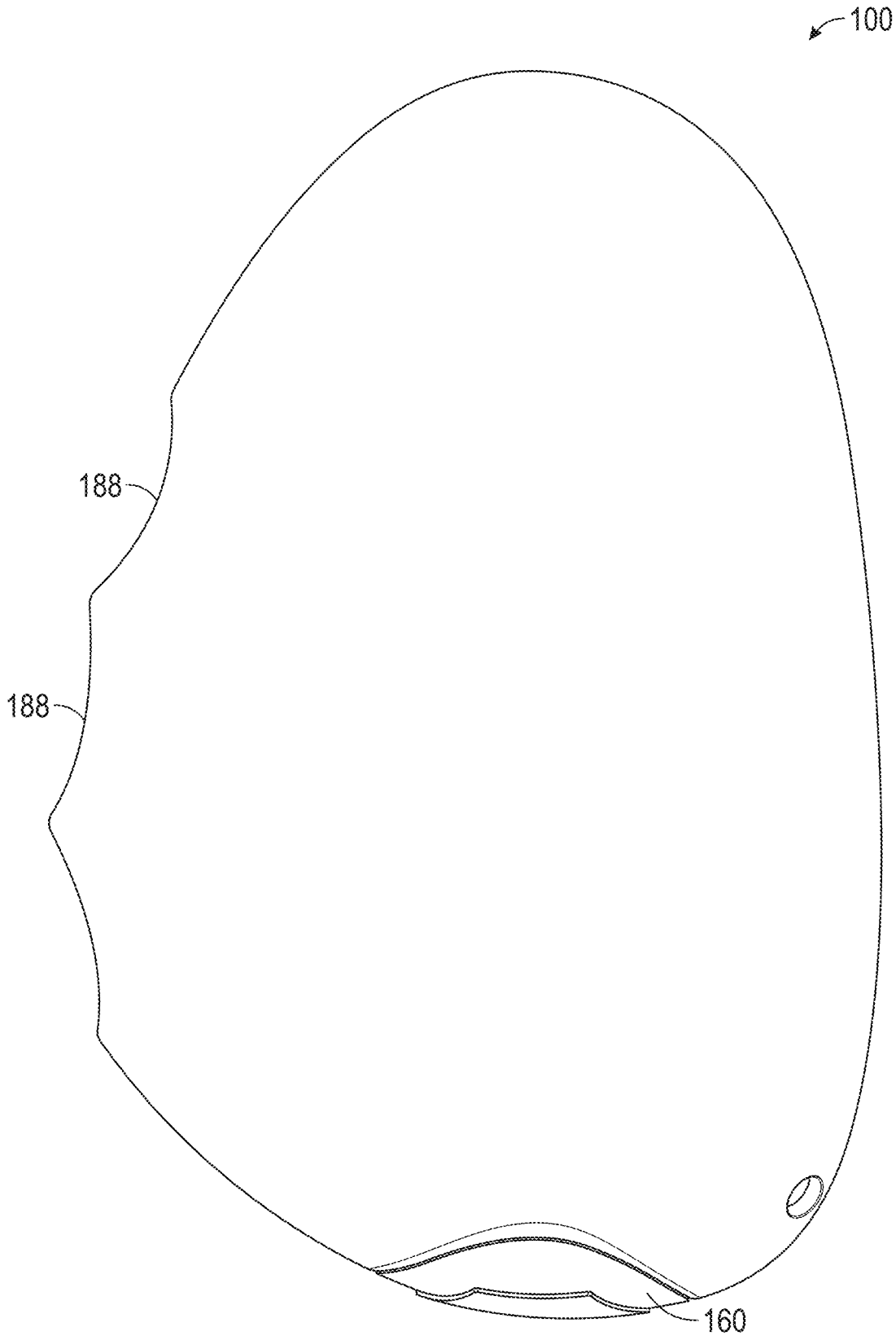
FIG. 18 is an opposite side view of the dispenser of FIG. 17.
Figure 19:
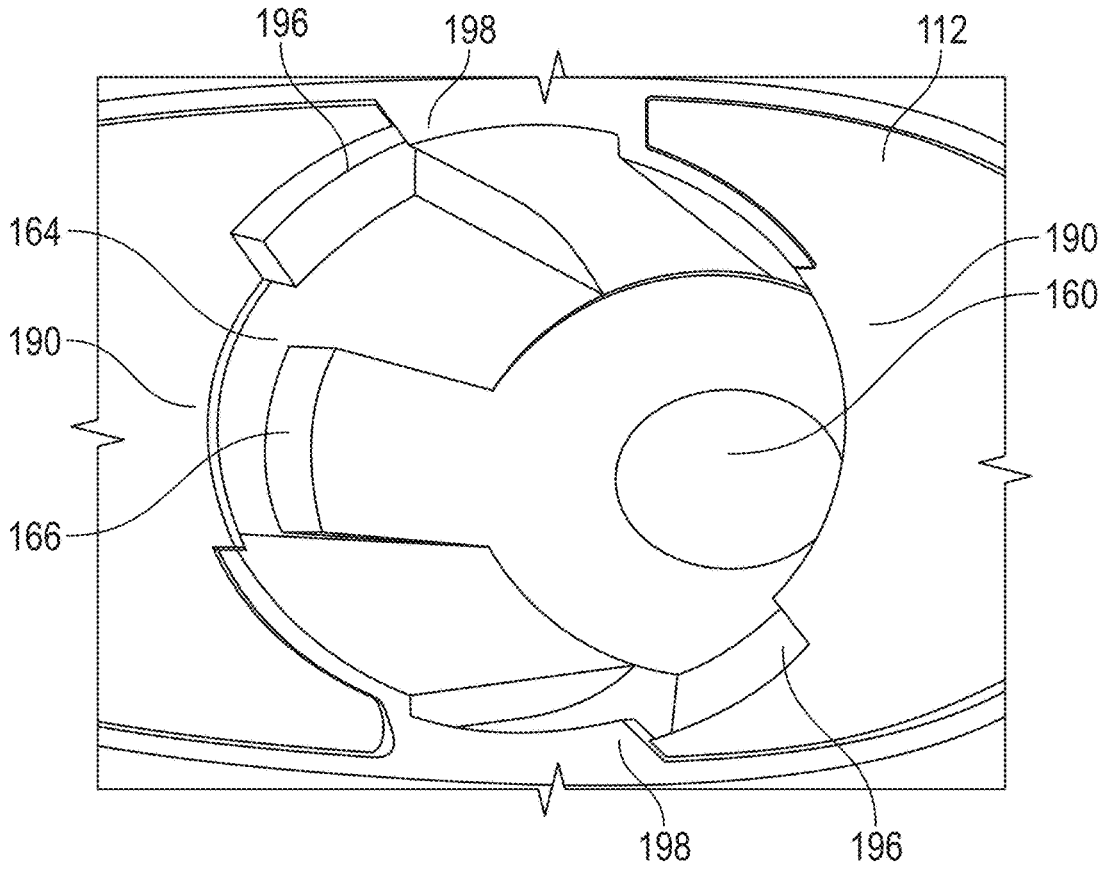
FIG. 19 is a partial perspective view of another one of many embodiments of a second case portion according to the disclosure.
Figure 20:
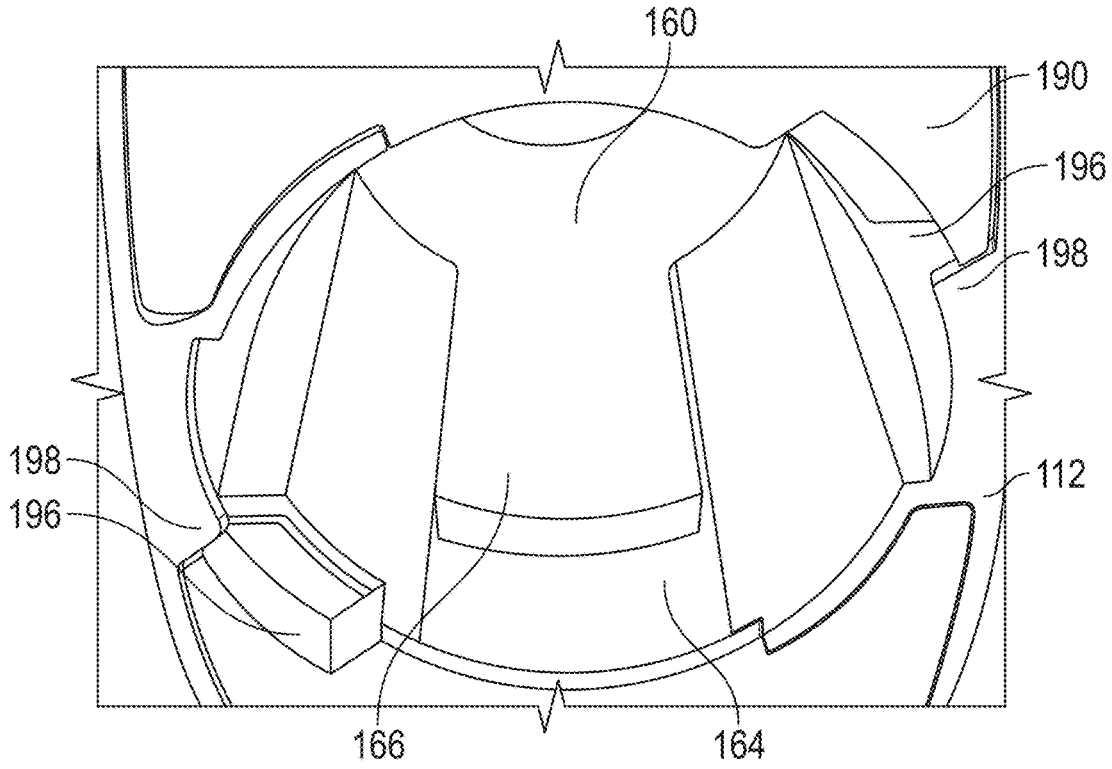
FIG. 20 is another partial perspective view of the second case portion of FIG. 19, showing a trigger in a released position.
Figure 21:
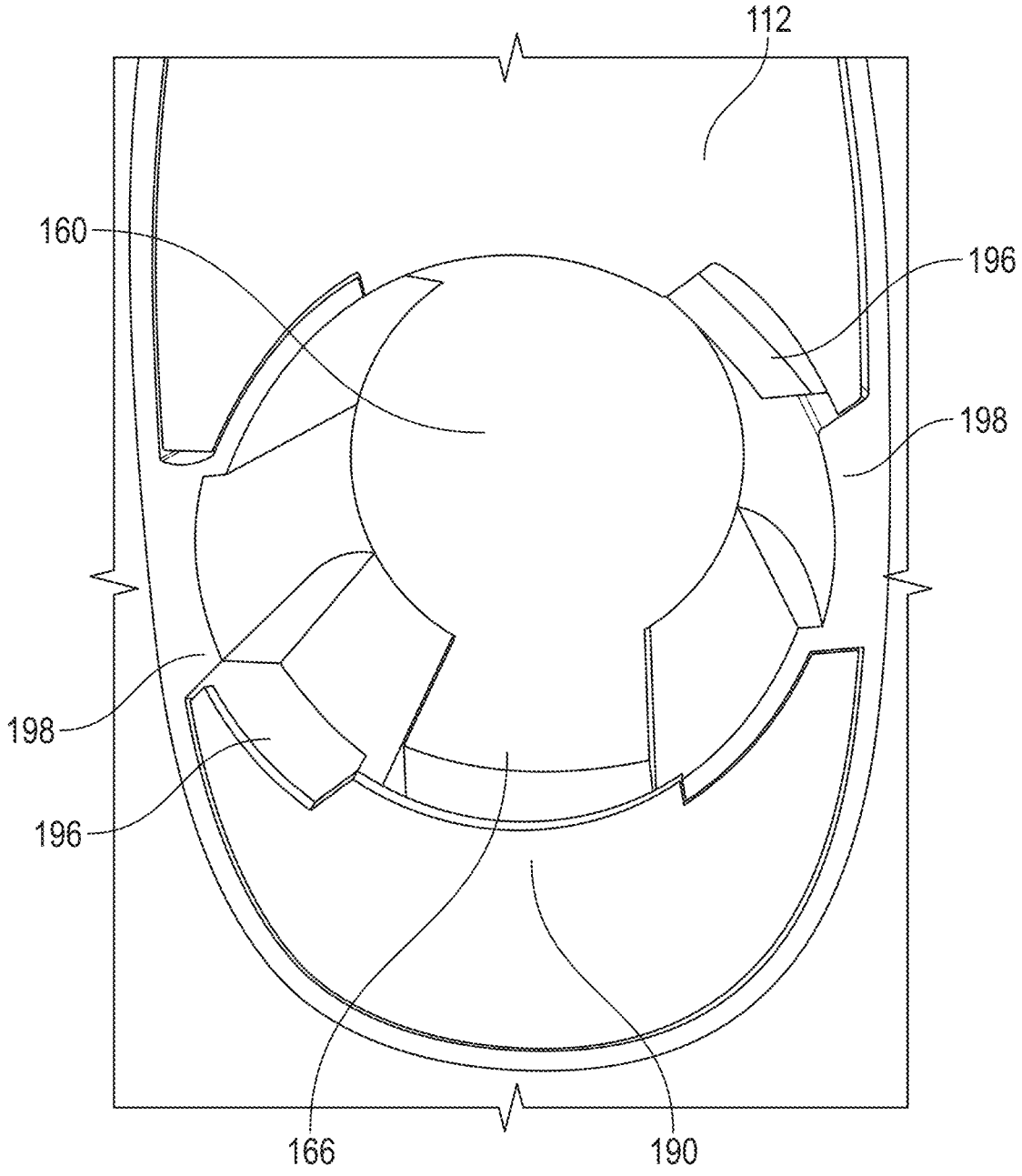
FIG. 21 is another partial perspective view of the second case portion of FIG. 19, showing a trigger in a partially activated position.
Figure 22:
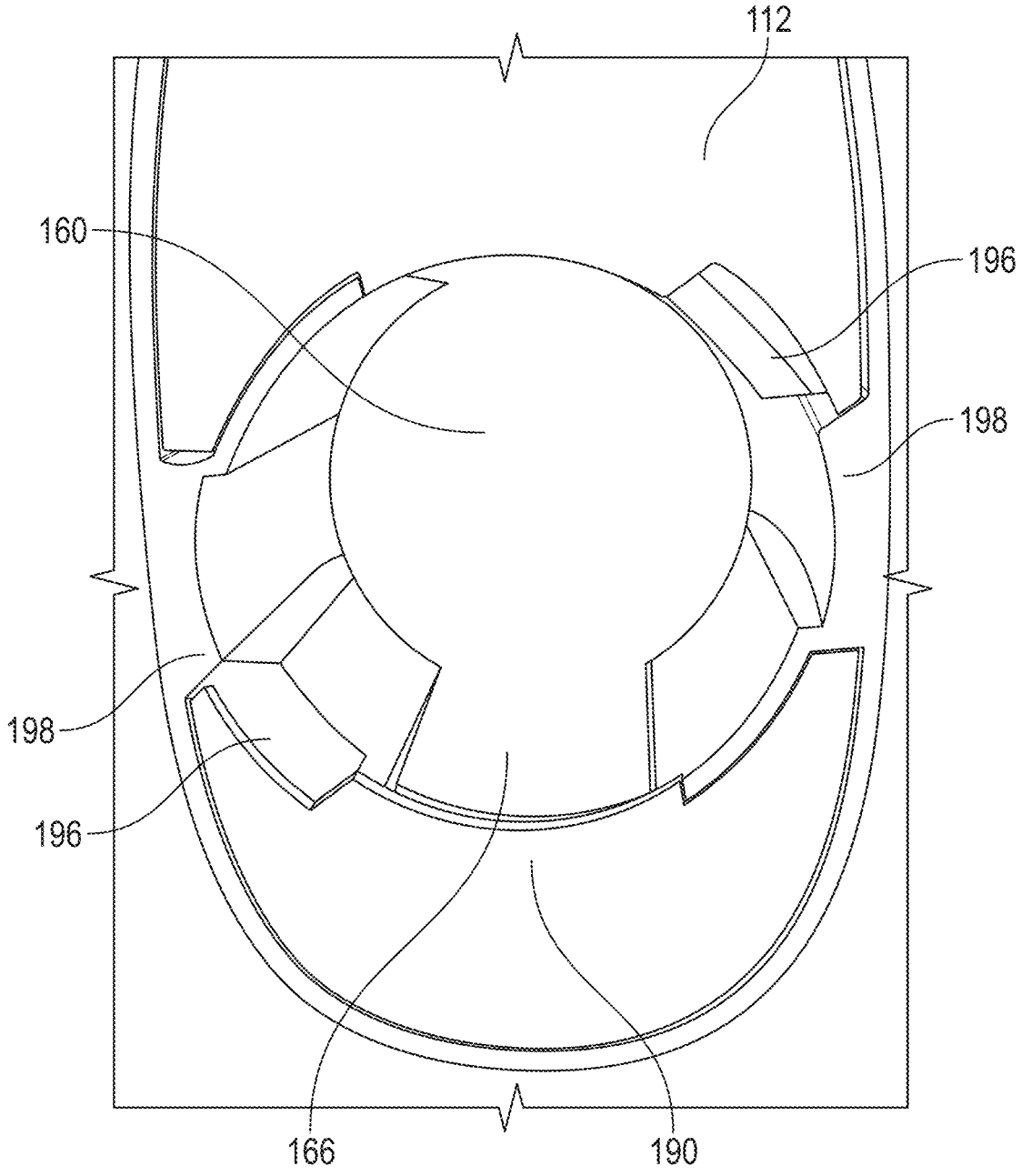
FIG. 22 is another partial perspective view of the second case portion of FIG. 19, showing a trigger in a fully activated position.
Figure 23:
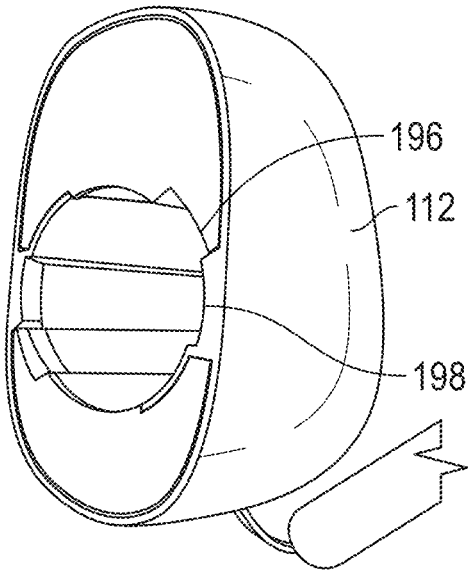
FIGS. 23-26 are additional perspective views of the second case portion of FIG. 19.
Figure 24:
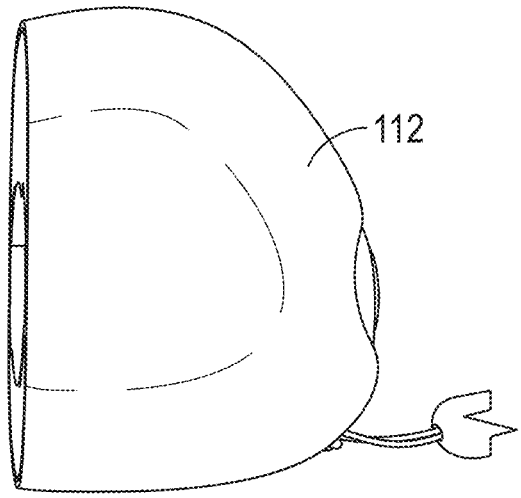
Figure 25:
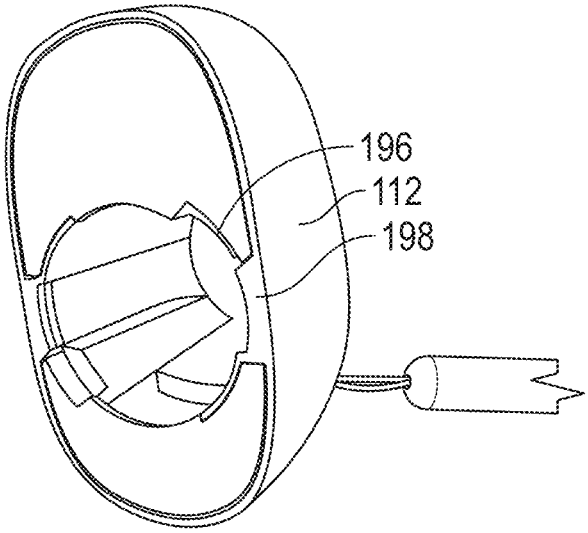
Figure 26:
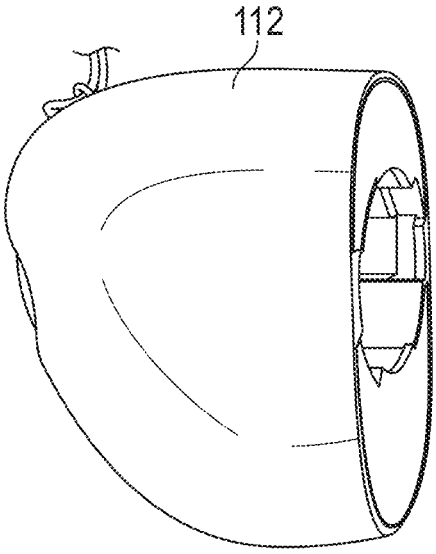
Figure 27:
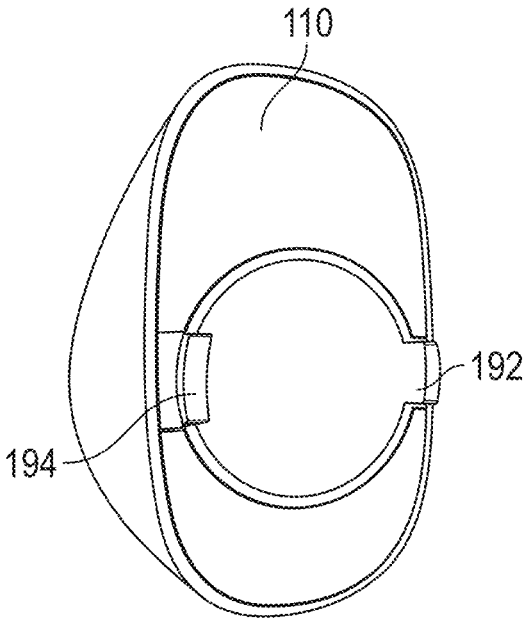
FIGS. 27-30 are perspective views of another one of many embodiments of a first case portion according to the disclosure.
Figure 28:
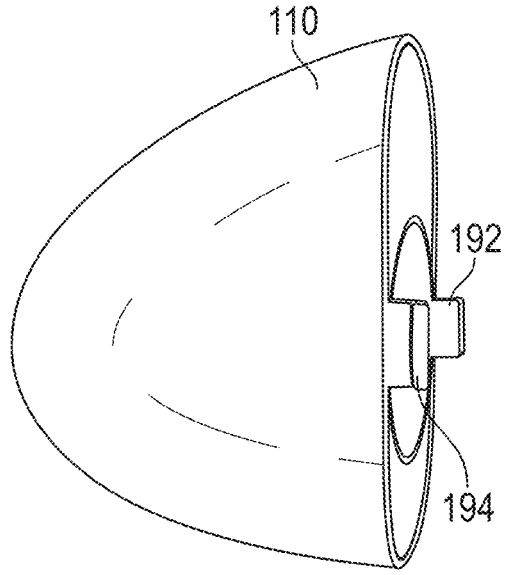
Figure 29:
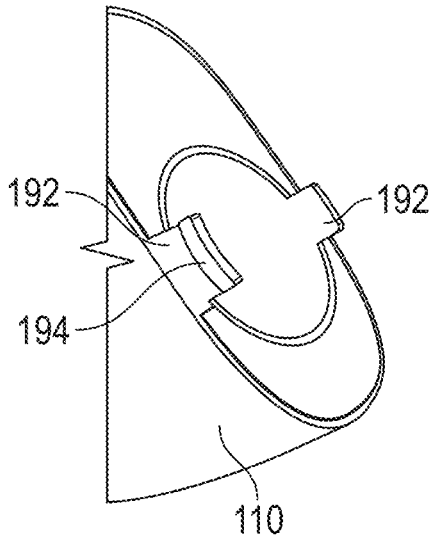
Figure 30:
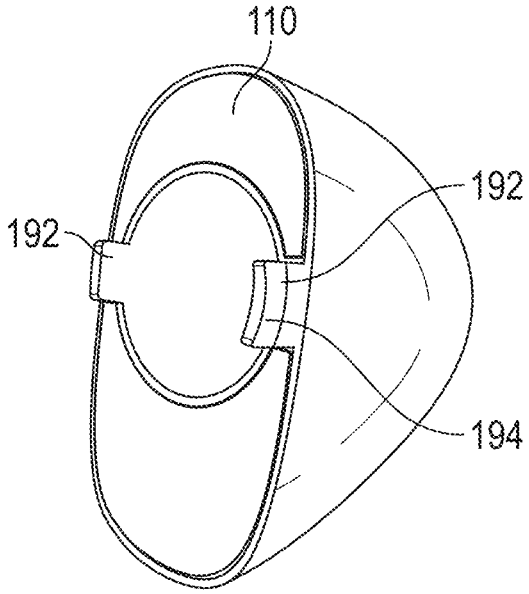

FIG. 1 is a perspective view of one of many embodiments of a dispenser according to the disclosure. FIG. 2 is a perspective view of another one of many embodiments of a dispenser according to the disclosure. FIG. 3 is a partial exploded view showing select components of one of many embodiments of a dispenser according to the disclosure. FIG. 4 is another partial exploded view showing select components of one of many embodiments of a dispenser according to the disclosure. FIG. 5 is a sectional view of one of many embodiments of a dispenser according to the disclosure. FIG. 6 is a partial exploded view of still another one of many embodiments of a dispenser according to the disclosure. FIG. 7 is another partial exploded view of the dispenser of FIG. 6. FIG. 8 is a perspective view of one of many embodiments of a pump assembly according to the disclosure. FIG. 9 is another perspective view of the pump assembly of FIG. 8. FIG. 10 is yet another perspective view of the pump assembly of FIG. 8. FIG. 11 is still another perspective view of the pump assembly of FIG. 8, shown with a container according to the disclosure. FIG. 12 is a perspective view of one of many embodiments of a first case portion according to the disclosure. FIG. 13 is a perspective view of one of many embodiments of a second case portion according to the disclosure. FIG. 14 is another perspective view of the second case portion of FIG. 13. FIG. 15 is another perspective view of the first case portion of FIG. 12. FIG. 16 is yet another perspective view of the first case portion of FIG. 12. FIG. 17 is a perspective view of one of many embodiments of a dispenser having finger grooves according to the disclosure. FIG. 18 is an opposite side view of the dispenser of FIG. 17. FIG. 19 is a partial perspective view of another one of many embodiments of a second case portion according to the disclosure. FIG. 20 is another partial perspective view of the second case portion of FIG. 19, showing a trigger in a released position. FIG. 21 is another partial perspective view of the second case portion of FIG. 19, showing a trigger in a partially activated position. FIG. 22 is another partial perspective view of the second case portion of FIG. 19, showing a trigger in a fully activated position. FIGS. 23-26 are additional perspective views of the second case portion of FIG. 19. FIGS. 27-30 are perspective views of another one of many embodiments of a first case portion according to the disclosure. FIGS. 1-30 are described in conjunction with one another.

In at least one embodiment, a dispenser 100 according to the disclosure can include one or more case(s) 102 having one or more chamber(s) 104 therein and one or more dispenser outlet(s) 106 in communication with the chamber (s) 104, one or more container(s) (or canister) 120 disposed within the chamber(s) 104, one or more pump assemblies 140 including one or more pump(s) 142 having one or more pump outlet(s) 144 that can be removably coupled to the dispenser outlet(s) 106, one or more trigger(s) 160 that can be configured to activate the pump(s) 142, or any combination thereof. In at least one embodiment, case 102 can include a first case portion 110 removably coupled to a second case portion 112. In at least one embodiment, dispenser outlet 106 can be through the first case portion 110. In at least one embodiment, trigger 160 can be coupled to the second case portion 112. In at least one embodiment, pump assembly 140 can include one or more collar(s) 146 removably coupled to the container(s) 120.

In at least one embodiment, dispenser 100 can include one or more lanyard hole(s) 114 disposed through a portion of the case 102. In at least one embodiment, dispenser 100 can include one or more lanyard(s) 116 secured to the lanyard hole(s) 114.

In at least one embodiment, container (or canister) 120 can be made of metal, such as aluminum, and/or otherwise be recyclable. In at least one embodiment, container 120 can be removably and/or replaceably coupled to the case 102. In at least one embodiment, container 120 can be pressed into the case 102, or a portion thereof. In at least one embodiment, container 120 can be removed from the case 102 and filled (or refilled) with lotion, such as sunscreen, or another product. In at least one embodiment, container 120 can be cylindrical. In at least one embodiment, container 120 can include a neck 122. In at least one embodiment, a portion of container 120, such as the neck 122, can be threaded. In at least one embodiment, a portion of container 120 can be conical. For example, a main body 124 of container 120 can be cylindrical with a first diameter, a conical portion 126 of the container 120 may join the main body 124 of the container 120 with the neck 122 having a second, smaller diameter. In at least one embodiment, container 120 can include an open bottom 128. In at least one embodiment, collar 146 can be threadably coupled to the threaded neck 122.

In at least one embodiment, trigger 160 can be configured to selectively move the container 120 and the collar 146 towards the dispenser outlet 106. In at least one embodiment, trigger 160 can be configured to selectively move the container 120 towards the dispenser outlet 106, and thereby compress or activate the pump 142, causing the pump 142 to dispense the product through the dispenser outlet 106. In at least one embodiment, trigger 160 can be slideably coupled to the second case portion 112. In at least one embodiment, at least a portion of trigger 160 can be accessible through an opening in a wall of the second case portion 112. In at least one embodiment, trigger 160 can include one or more air hole(s) 162 in fluid communication with an atmosphere surrounding the dispenser 100.

In at least one embodiment, trigger 160 comprises features that interplay with the second case portion 112 to guide the trigger 160 in a linear travel path and prevent misalignment that could cause a jam. In at least one embodiment, trigger 160 can be rotationally fixed relative to the second case portion 112. In at least one embodiment, second case portion 112 can include one or more groove(s) 164 and trigger 160 can include one or more tongue(s) 166 slideably disposed within the groove(s) 164. In at least one embodiment, the tongues 166 and the groove(s) 164 can interplay to guide the trigger 160 in a linear travel path and prevent misalignment that could cause a jam.

In at least one embodiment, the tongue(s) 166 can extend from the trigger 160 into the second case portion 112. In at least one embodiment, movement of the trigger 160 can be limited by the tongue(s) 166 sliding within the groove(s) 164 until the tongue(s) 166 engage a cover plate 190. In at least one embodiment, the trigger 160 can be installed into the second case portion 112 by aligning the tongue(s) 166 with the groove(s) 164, sliding the trigger 160 into the second case portion 112, and then securing the cover plate 190 to the second case portion 112, thereby locking the trigger 160 within the second case portion 112. In at least one embodiment, the cover plate 190 can be secured to the second case portion 112 by press fit, welding, use of an adhesive, or any combination thereof.

In at least one embodiment, dispenser 100 can include one or more trigger frame(s) 168 disposed within second case portion 112. In at least one embodiment, trigger 160 can be slideably coupled to the trigger frame 168. In at least one embodiment, trigger frame 168 can be configured to retain trigger 160 within the second case portion 112 when container 120 is removed from the case 102. For example, in at least one embodiment, groove 164 may be in the trigger frame 168, such that tongue 166 slideably disposed within the groove 164 retains the trigger 160 within the second case portion 112 when container 120 is removed from the case 102.

In at least one embodiment, the first case portion 110 can include one or more seat(s) 148. In at least one embodiment, pump outlet 144 can be sealingly coupled to the seat 148. In at least one embodiment, seat 148 can include one or more groove(s) 150 in an interior wall of the first case portion 110, and at least a portion of pump outlet 144 can be disposed within the groove 150.

In at least one embodiment, collar 146 can be press fitted into the first case portion 110 and/or container 120 can be press fitted into the second case portion 112. In at least one embodiment, collar 146 can retain the pump 142 in fluid communication with an interior of the container 120. For example, collar 146 can be threadably coupled to container 120 thereby retaining the pump 142 in fluid communication with an interior of the container 120.

In at least one embodiment, pump 142 can include one or more spring(s) 152 biasing the collar 146 and a portion of the pump away from the dispenser outlet 106. In at least one embodiment, pump 142 can include one or more valve(s) 154 that allow selective passage of the product. In at least one embodiment, when trigger 160 is moved towards the dispenser outlet 106, the spring 152 can be compressed, activating the pump 142, and thereby causing the pump 142 to dispense the product through the dispenser outlet 106. In at least one embodiment, when the trigger 160 is released or deactivated, the spring 152 deactivates or expands the pump 142, thereby causing the pump 142 to draw the product from the canister or container 120 through the valve 154. In at least one embodiment, valve 154 can prevent the product from flowing back into the container upon activation of the trigger 160.

In at least one embodiment, container 120, collar 146 and trigger 160 can be biased in a direction away from the dispenser outlet 106, such as by the spring 152. In at least one embodiment, container 120, collar 146 and trigger 160 can be biased in a direction towards an opening through the second case portion 112.

In at least one embodiment, dispenser 100 can include one or more piston(s) 130 slideably coupled to an internal surface of container 120. In at least one embodiment, piston 130 can be configured to move in a direction towards the dispenser outlet 106 as a volume of a substance stored, such as a lotion or other product, in the container 120 decreases.

In at least one embodiment, pump 142 can include a pump inlet end 156 disposed within the container 120. In at least one embodiment, valve 154 can be positioned at or near the pump inlet end 156 of the pump 142. In at least one embodiment, piston 130 can include a first end 132 that faces towards the dispenser outlet 106. In at least one embodiment, the first end 132 of the piston 130 can include an opening 134 configured to receive at least a portion of the pump inlet end 156. In at least one embodiment, the pump inlet end 156 can include a pump inlet 158, such as an opening or the valve 154. In at least one embodiment, the opening 134 in the first end 132 of the piston 130 can direct a substance stored in the container 120, such as lotion or another product, into the pump inlet 158 during pump operation.

In at least one embodiment, piston 130 can be sealingly coupled to an internal surface of container 120. In at least one embodiment, the piston 130 can include one or more grooves 136 with one or more O-rings 138 positioned there within to sealingly engage the internal surface of the container 120. In at least one embodiment, piston 130 can include at least two grooves 136, each with an O-ring 138 therewithin to maintain proper alignment of the piston 130 with the container 120. In at least one embodiment, piston 130 can move toward the neck 122 of the container 120, as the product in the container 120 is being drawn into the pump 142. In at least one embodiment, air hole 162 in the trigger 160 allows air to fill the space within the container 120 as the piston 130 moves toward the neck 122 of the container 120.

In at least one embodiment, container 120 can include a bottom cap 170 adjacent the piston 130 and/or the open bottom 128 of the container 120. In at least one embodiment, the bottom cap 170 can include an air vent 172. In at least one embodiment, the air vent 172 in the bottom cap 170 allows air to fill the space within the container 120 as the piston 130 moves toward the neck 122 of the container 120.

In at least one embodiment, dispenser outlet 106 of the first case portion 110 can include one or more insert(s) (or seats) 148 configured to ensure a tight fit with the pump outlet 144, thereby creating a vacuum inside the cartridge or container 120 upon deactivation of the trigger 160. In at least one embodiment, collar 146 can include a self-extracting mechanism configured to be engaged by the user when unthreading the collar 146 from the container 120. For example, in at least one embodiment, pump 142 (or one or more components thereof) can be coupled to collar 146 for allowing collar 146 and pump 142 to be removed from and/or attached to container 120 as a single unit. In such an embodiment, which is but one of many, pump 142 (or one or more components thereof) can be coupled to collar 146 removably or fixedly, in whole or in part.

In at least one embodiment, the first and second case portions 110, 112 can be threadably coupled to one another. In at least one embodiment, dispenser 100 can include one or more protrusion(s) 108 disposed in a thread on one of the first and second case portions 110, 112. In at least one embodiment, protrusion 108 can provide a mechanical indication when the first and second case portions 110, 112 are fully coupled with one another. In at least one embodiment, one of the first and second case portions 110, 112 can drive a portion of the container 120 into the other of the first and second case portions 110, 112 as the first and second case portions 110, 112 are threaded to one another. In at least one embodiment, one of the first and second case portions 110, 112 comprises a neck 118 configured to be at least partially disposed within the other of the first and second case portions 110, 112. In at least one embodiment, container 120 can be disposed through the neck 112. In at least one embodiment, neck 112 can be threaded and can be threadably received within and coupled to the other of the first and second case portions 110, 112. While first and second case portions 110, 112 are depicted herein as threadably coupled with one another for exemplary purposes (see, e.g., FIGS. 6 and 9-10), this need not be the case and, in at least one embodiment, first and second case portions 110, 112 can be removably coupled with one another in one or more other manners, whether separately or in combination with threads. For example, in at least one embodiment, first and second case portions 110, 112 can be removably coupled with one another by way of a twist-and-lock connection, such as a quarter-turn connection, by way of a press fit or interference fit connection, by way of one or more mechanical fasteners, or in another manner desired or required in accordance with an implementation of the disclosure.

In at least one embodiment, the first and second case portions 110, 112 can be coupled to one another by other than threading as described above, such as press-fit. In at least one embodiment, the first and second case portions 110, 112 can be coupled to one another by a partial turn, such as a quarter turn. In at least one embodiment, one or more tabs 192 can extend from either one of the first and second case portions 110, 112. In at least one embodiment, tab(s) 192 can include one or more flanges 194 extending therefrom. In at least one embodiment, the other one of the first and second case portions 110, 112 can include one or more slots 196. In at least one embodiment, dispenser 100 can include one or more shoulders 198 adjacent slot(s) 196. In at least one embodiment, at least a portion of tabs 192 and/or flanges 194 can be slidingly received within slot(s) 196, then the first and second case portions 110, 112 can be rotated with respect to one another, until the tabs 192 and/or flanges 194 engage the shoulders 198, thereby coupling the first and second case portions 110, 112 to one another.

In at least one embodiment, one set of tab 192, flange 194, slot 196, shoulder 198, or any combination thereof, can be sized differently than another such set. For example, a first tab 192 and a corresponding first slot 196 can be larger, such as wider, than a second tab 192 and a corresponding second slot 196. In at least one embodiment, such size differences can be utilized to ensure that the first and second case portions 110, 112 can be consistently properly aligned with one another, e.g., during repeated opening and closing cycles.

In at least one embodiment, dispenser 100 can be water buoyant. In at least one embodiment, dispenser 100 can include one or more air spaces 180 disposed radially between an external surface of the container 120 and an external surface of the case 102. In at least one embodiment, at least one of the one or more air spaces 180 can be at least partially bounded by a wall 182 disposed radially between the external surface of the container 120 and the external surface of the case 102.

In at least one embodiment, a cartridge assembly for a dispenser, such as that described above, can include one or more cartridge(s) 120 having a threaded mouth 122 and an opposing bottom cap 170 with an air vent 172 therethrough, one or more pump(s) 142 configured to be threadably coupled to the threaded mouth 122 of cartridge 120, one or more piston(s) 130 pressed-fit through a bottom of cartridge 120, or any combination thereof. In at least one embodiment, piston 130 can be secured within cartridge 120 by friction between one or more O-rings 138 and an inner wall of the cartridge 120. In at least one embodiment, the bottom cap 170 can provide an even surface for engaging a trigger 160 of dispenser 100 and compressing the pump 142. In at least one embodiment, air vent 172 can allow air into the bottom of cartridge 120, facilitating free movement of the piston 130 within cartridge 120.

In at least one embodiment, a piston assembly for a dispenser 100, such as that described above, can include one or more elongated piston(s) 130 to provide controlled force resistance against the vacuum and prevent misalignment, two or more circumferential grooves 136 along the piston 130, two O-rings 138 within the grooves 136 to create a press-fit assembly within a cartridge 120 of the dispenser 100, a cavity (or opening) 134 within a product facing surface 132 of the piston 130 configured to receive a pump 142 of the dispenser 100, a beveled edge 174 around the product facing surface 132 of the piston 130 to accommodate a neck 122 of cartridge 120, or any combination thereof. In at least one embodiment, the cavity 134 and/or the beveled edge 174 can provide enhanced dispensing of a product from the cartridge 120.

In at least one embodiment, the piston can have a length of approximately 0.472 inches. In at least one embodiment, the O-rings can be made of cork. In at least one embodiment, the O-rings can have a thickness of approximately 0.09 inches. In at least one embodiment, the O-rings can have a diameter of approximately 0.862 inches.

As shown in, e.g., FIGS. 1-2 for exemplary purposes, in at least one embodiment, dispenser 100 can have a relatively smooth exterior surface. However, this need not be the case and, in at least one embodiment, the exterior surface of dispenser 100 can include one or more features or components for supporting firm gripping or holding of dispenser 100 by a user. For example, in at least one embodiment, dispenser 100 can include one or more finger grooves 188 for cooperating with one or more fingers of a user during holding or use of dispenser 100 (see, e.g., FIGS. 20-23). In such an embodiment, which is but one of many, one or more finger grooves 188 can be shaped and arranged, for instance, for cooperating with one or more fingers of a user to resist slipping of dispenser 100 out of a user's hand during dispensing operations, such as under conditions where dispenser 100 and/or a user's hand may be wet or otherwise slippery.

In at least one embodiment, a dispenser can include a case having a chamber therein and a dispenser outlet in communication with the chamber, a container disposed within the chamber, a pump assembly including a pump having a pump outlet that can be removably coupled to the dispenser outlet, a trigger that can be configured to activate the pump, or any combination thereof. In at least one embodiment, the case can include a first case portion removably coupled to a second case portion. In at least one embodiment, the dispenser outlet can be through the first case portion. In at least one embodiment, the trigger can be coupled to the second case portion. In at least one embodiment, the pump assembly can include a collar removably coupled to the container.

In at least one embodiment, the container can be metal. In at least one embodiment, the container can be removably and/or replaceably coupled to the case. In at least one embodiment, the dispenser can include a lanyard hole disposed through a portion of the case.

In at least one embodiment, the trigger can be configured to selectively move the container and the collar towards the dispenser outlet. In at least one embodiment, the trigger can be slideably coupled to the second case portion. In at least one embodiment, at least a portion of the trigger can be accessible through an opening in a wall of the second case portion. In at least one embodiment, the trigger can include an air hole in fluid communication with an atmosphere surrounding the dispenser.

In at least one embodiment, the trigger comprises features that interplay with the second case portion to guide the trigger in a linear travel path and prevent misalignment that could cause a jam. In at least one embodiment, the trigger can be rotationally fixed relative to the second case portion. In at least one embodiment, the second case portion can include a groove and the trigger can include a tongue slideably disposed within the groove.

In at least one embodiment, the dispenser can include a trigger frame disposed within the second case portion. In at least one embodiment, the trigger can be slideably coupled to the trigger frame. In at least one embodiment, the trigger frame can be configured to retain the trigger within the second case portion when the container is removed from the case.

In at least one embodiment, the first case portion can include a seat. In at least one embodiment, the pump outlet can be sealingly coupled to the seat. In at least one embodiment, the seat can include a groove in an interior wall of the first case portion, and at least a portion of the pump outlet can be disposed within the groove.

In at least one embodiment, the collar can be press fitted into the first case portion and/or the container can be press fitted into the second case portion. In at least one embodiment, the collar can retain the pump in fluid communication with an interior of the container. For example, the collar can be threadably coupled to the container thereby retaining the pump in fluid communication with an interior of the container.

In at least one embodiment, the first and second case portions can be threadably coupled to one another. In at least one embodiment, the dispenser can include a protrusion disposed in a thread on one of the first and second case portions. In at least one embodiment, the protrusion can provide a mechanical indication when the first and second case portions are fully coupled with one another. In at least one embodiment, one of the first and second case portions can drive a portion of the container into the other of the first and second case portions as the first and second case portions are threaded to one another. In at least one embodiment, one of the first and second case portions comprises a neck configured to be at least partially disposed within the other of the first and second case portions. In at least one embodiment, the container can be disposed through the neck.

In at least one embodiment, the container, the collar and the trigger can be biased in a direction away from the dispenser outlet. In at least one embodiment, the container, the collar and the trigger can be biased in a direction towards an opening through the second case portion.

In at least one embodiment, the dispenser can be water buoyant. In at least one embodiment, the dispenser can include one or more air spaces disposed radially between an external surface of the container and an external surface of the case. In at least one embodiment, at least one of the one or more air spaces can be at least partially bounded by a wall disposed radially between the external surface of the container and the external surface of the case.

In at least one embodiment, the dispenser can include a piston slideably coupled to an internal surface of the container. In at least one embodiment, the piston can be configured to move in a direction towards the dispenser outlet as a volume of a substance stored in the container decreases. In at least one embodiment, the pump can include a pump inlet end disposed within the container. In at least one embodiment, the piston can include a first end that faces towards the dispenser outlet. In at least one embodiment, the first end of the piston can include an opening configured to receive at least a portion of the pump inlet end. In at least one embodiment, the pump inlet end can include a pump inlet. In at least one embodiment, the opening in the first end of the piston can direct a substance stored in the container into the pump inlet during pump operation.

In at least one embodiment, the dispenser outlet of the first case portion can include an insert configured to ensure a tight fit with the pump outlet, thereby creating a vacuum inside the cartridge upon deactivation of the trigger. In at least one embodiment, the collar can include a self-extracting mechanism configured to be engaged by the user when unthreading the collar from the container.

In at least one embodiment, a cartridge assembly for a dispenser, such as that described above, can include a cartridge having a threaded mouth and an opposing bottom cap with an air vent therethrough, a pump configured to be threadably coupled to the threaded mouth of the cartridge, a piston pressed-fit through a bottom of the cartridge, or any combination thereof. In at least one embodiment, the piston can be secured within the cartridge by friction between one or more O-rings and an inner wall of the cartridge. In at least one embodiment, the bottom cap can provide an even surface for engaging a trigger of the dispenser and compressing the pump. In at least one embodiment, the air vent can allow air into the bottom of the cartridge, facilitating free movement of the piston within the cartridge.

In at least one embodiment, a piston assembly for a dispenser, such as that described above, can include an elongated piston to provide controlled force resistance against the vacuum and prevent misalignment, two or more circumferential grooves along the piston, two O-rings within the grooves to create a press-fit assembly within a cartridge of the dispenser, a cavity within a product facing surface of the piston configured to receive a pump of the dispenser, a beveled edge around the product facing surface of the piston to accommodate a neck of the cartridge, or any combination thereof. In at least one embodiment, the cavity and/or the beveled edge can provide enhanced dispensing of a product from the cartridge.

Other and further embodiments utilizing one or more aspects of the disclosure can be devised without departing from the spirit of Applicant's disclosure. For example, the devices, systems and methods can be implemented for numerous different types and sizes in numerous different industries. Further, the various methods and embodiments of the devices, systems and methods can be included in combination with each other to produce variations of the disclosed methods and embodiments. Discussion of singular elements can include plural elements and vice versa. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the inventions has been described. Obvious modifications and alterations to the described embodiments are available to those of ordinary skill in the art having the benefits of the present disclosure. The disclosed and undisclosed embodiments are not intended to limit or restrict the scope or applicability of the inventions conceived of by the Applicant, but rather, in conformity with the patent laws, Applicant intends to fully protect all such modifications and improvements that come within the scope or range of equivalents of the following claims.

What is claimed is:

1. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container; and wherein the pump outlet is removably coupled to the dispenser outlet; and further comprising a piston slideably coupled to an internal surface of the container, wherein the piston is configured to move in a direction towards the dispenser outlet as a volume of a substance stored in the container decreases.

2. The dispenser of claim 1, wherein the container is metal and is removably and replaceably coupled to the case.

3. The dispenser of claim 1, further comprising a groove disposed within the second case portion; wherein the trigger comprises a tongue slideably disposed within the groove; wherein the trigger is rotationally fixed relative to the second case portion; wherein at least a portion of the trigger is accessible through an opening in a wall of the second case portion.

4. The dispenser of claim 1, wherein the first case portion comprises a seat; wherein the pump outlet is sealingly coupled to the seat; wherein the seat comprises a groove in an interior wall of the first case portion; and where at least a portion of the pump outlet is disposed within the groove.

5. The dispenser of claim 1, wherein the collar is press fitted into the first case portion and wherein the container is press fitted into the second case portion.

6. The dispenser of claim 1, wherein the collar is threadably coupled to the container and thereby retains the pump in fluid communication with an interior of the container.

7. The dispenser of claim 1, further comprising a trigger frame disposed within the second case portion; wherein the trigger frame is configured to retain the trigger within the second case portion when the container is removed from the case; wherein the trigger is slideably coupled to the trigger frame; and wherein the trigger is configured to selectively move the container and the collar towards the dispenser outlet.

8. The dispenser of claim 1, wherein the first and second case portions are threadably coupled to one another.

9. The dispenser of claim 8, further comprising a protrusion disposed in a thread on one of the first and second case portions, wherein the protrusion is configured to provide a mechanical indication when the first and second case portions are fully coupled with one another.

10. The dispenser of claim 1, wherein one of the first and second case portions comprises a neck configured to be at least partially disposed within the other of the first and second case portions, and wherein the container is disposed through the neck.

11. The dispenser of claim 1, wherein the container, the collar and the trigger are biased in a direction away from the dispenser outlet.

12. The dispenser of claim 1, further comprising one or more air spaces disposed radially between an external surface of the container and an external surface of the case; wherein at least one of the one or more air spaces is at least partially bounded by a wall disposed radially between the external surface of the container and the external surface of the case; and wherein the dispenser is water buoyant.

13. The dispenser of claim 1, wherein the pump comprises a pump inlet end disposed within the container; wherein the piston has a first end that faces towards the dispenser outlet; wherein the first end of the piston comprises an opening configured to receive at least a portion of the pump inlet end; wherein the pump inlet end comprises a pump inlet; and wherein the opening in the first end of the piston is configured to direct a substance stored in the container into the pump inlet during pump operation.

14. The dispenser of claim 1, wherein the trigger comprises one or more tongues configured to guide the trigger in a linear travel path and prevent misalignment.

15. The dispenser of claim 1, wherein the dispenser outlet of the first case portion includes an insert configured to ensure a tight fit with the pump outlet for creating a vacuum inside the container upon deactivation of the trigger.

16. The dispenser of claim 1, wherein the collar includes a self-extracting mechanism configured to be engaged by a user when unthreading the collar from the container.

17. A dispenser, comprising:

a case comprising a first case portion removably coupled to a second case portion;

a chamber within the case; and a cartridge assembly removably disposed within the chamber, wherein the cartridge assembly comprises a cartridge having a threaded mouth and an opposing bottom cap with an air vent therethrough;

a pump configured to be threadably coupled to the threaded mouth of the cartridge;

a piston pressed-fit through a bottom of the cartridge, the piston configured to be secured within the cartridge by friction between one or more O-rings and an inner wall of the cartridge;

wherein the bottom cap includes a surface for engaging a trigger of the dispenser and compressing the pump; and wherein the air vent allows air into the bottom of the cartridge for facilitating free movement of the piston within the cartridge.

18. The dispenser of claim 17, further comprising:

a dispenser outlet through the first case portion and in communication with the chamber; and a trigger coupled to the second case portion;

wherein the pump comprises a collar and a pump outlet;

wherein the collar is removably coupled to the cartridge; and wherein the pump outlet is removably coupled to the dispenser outlet.

19. The dispenser of claim 18, wherein the pump further comprises a pump inlet end disposed within the cartridge;

wherein the piston has a first end that faces towards the dispenser outlet; wherein the first end of the piston comprises an opening configured to receive at least a portion of the pump inlet end; wherein the pump inlet end comprises a pump inlet; and wherein the opening in the first end of the piston is configured to direct a substance stored in the cartridge into the pump inlet during pump operation.

20. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container; and wherein the pump outlet is removably coupled to the dispenser outlet; and further comprising a groove disposed within the second case portion; wherein the trigger comprises a tongue slideably disposed within the groove; wherein the trigger is rotationally fixed relative to the second case portion; wherein at least a portion of the trigger is accessible through an opening in a wall of the second case portion.

21. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container;

wherein the pump outlet is removably coupled to the dispenser outlet; and wherein the collar is press fitted into the first case portion and wherein the container is press fitted into the second case portion.

22. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container; and wherein the pump outlet is removably coupled to the dispenser outlet; and further comprising a trigger frame disposed within the second case portion; wherein the trigger frame is configured to retain the trigger within the second case portion when the container is removed from the case; wherein the trigger is slideably coupled to the trigger frame; and wherein the trigger is configured to selectively move the container and the collar towards the dispenser outlet.

23. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container; and wherein the pump outlet is removably coupled to the dispenser outlet; and further comprising one or more air spaces disposed radially between an external surface of the container and an external surface of the case; wherein at least one of the one or more air spaces is at least partially bounded by a wall disposed radially between the external surface of the container and the external surface of the case; and wherein the dispenser is water buoyant.

24. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container; and wherein the pump outlet is removably coupled to the dispenser outlet; and wherein the trigger comprises one or more tongues configured to guide the trigger in a linear travel path to prevent misalignment.

25. A dispenser, comprising:

a case comprising a first case portion removably coupled to a second case portion;

a chamber within the case;

a dispenser outlet through the first case portion and in communication with the chamber;

a container disposed within the chamber;

a trigger coupled to the second case portion; and a pump assembly comprising a collar and a pump having a pump outlet;

wherein the collar is removably coupled to the container;

wherein the pump outlet is removably coupled to the dispenser outlet; and wherein the dispenser outlet of the first case portion includes an insert configured to ensure a tight fit with the pump outlet for creating a vacuum inside the container upon deactivation of the trigger.

* * * * *